US010106285B2

(12) United States Patent
Bolhous et al.

(10) Patent No.: US 10,106,285 B2
(45) Date of Patent: Oct. 23, 2018

(54) FLEXIBLE PACKAGE HAVING A RECYCLABLE CLOSURE AND A METHOD OF CONFIGURING SAID PACKAGE FOR RECYCLING

(71) Applicant: Charter NEX Films, Inc., Milton, WI (US)

(72) Inventors: Mary K. Bolhous, East Lake Geneva, WI (US); Thomas G. Ziolkowski, Whitewater, WI (US); Thomas H. Roessler, Appleton, WI (US)

(73) Assignee: Charter NEX Films, Inc., Milton, WI (US)

( * ) Notice: Subject to any disclaimer, the term of this patent is extended or adjusted under 35 U.S.C. 154(b) by 527 days.

(21) Appl. No.: 14/829,707

(22) Filed: Aug. 19, 2015

(65) Prior Publication Data

US 2016/0052690 A1 Feb. 25, 2016

Related U.S. Application Data

(60) Provisional application No. 62/039,589, filed on Aug. 20, 2014.

(51) Int. Cl.

| | |
|---|---|
| ***B65D 75/54*** | (2006.01) |
| ***B65B 69/00*** | (2006.01) |
| ***B65D 33/00*** | (2006.01) |

(52) U.S. Cl.

CPC ..... *B65B 69/0008* (2013.01); *B65D 33/00* (2013.01); *B65D 2565/385* (2013.01)

(58) Field of Classification Search

CPC .... B65D 33/00; B65D 33/1691; B65D 33/18; B65D 33/20; B65D 2565/385;

(Continued)

(56) References Cited

U.S. PATENT DOCUMENTS

| | | |
|---|---|---|
| 322,453 A | 7/1885 | Howe |
| 3,164,695 A | 1/1965 | Sanni |

(Continued)

FOREIGN PATENT DOCUMENTS

| | | |
|---|---|---|
| JP | 2002321747 | 11/2002 |
| WO | 2012003042 | 1/2012 |

OTHER PUBLICATIONS

Section III Pouch Construction, May 5, 2010, 96 pages, Allied Development Corp.

*Primary Examiner* — Hemant M Desai
*Assistant Examiner* — Valentin Neacsu
(74) *Attorney, Agent, or Firm* — Thomas J. Connelly; Northwind IP Law, S.C.

(57) ABSTRACT

A flexible package having a recyclable closure is disclosed along with a method of configuring the package for recycling. The flexible package includes a front surface, a back surface, an open first end, a closed second end, and a pair of sides joining the open first end to the closed second end to form an enclosure. A closing seal is formed to close the open first end after the enclosure has been filled with a product. The flexible package also has a recyclable closure spaced apart from the closing seal. The recyclable closure has a first end and a second end. The first end is secured to one of the front or back surfaces, whereby once the product has been removed from the enclosure, the flexible package is configured into a 3-dimensional shape. The recyclable closure is then used to retain the flexible package in the 3-dimensional shape.

17 Claims, 19 Drawing Sheets

(58) Field of Classification Search

CPC .. B65D 17/163; B65D 17/168; B65D 17/166; B65D 17/165; B65D 17/24; B65D 2251/0093; B65D 2577/205; B65B 69/0008

USPC ..... 53/412, 469, 419; 383/84–91, 105, 204, 383/210, 210.1, 211, 2, 62; 220/270, 220/266, 265, 359.4, 359.2, 359.1; 206/554, 225–226

See application file for complete search history.

(56) References Cited

U.S. PATENT DOCUMENTS

| | | | | |
|---|---|---|---|---|
| 3,301,466 | A | 1/1967 | Perino et al. | |
| 3,537,636 | A | 11/1970 | Rochette | |
| 3,806,024 | A * | 4/1974 | Marchesani | B65D 33/1691 383/62 |
| 4,184,596 | A | 1/1980 | Avery | |
| 4,902,141 | A | 2/1990 | Linnewiel | |
| 4,911,563 | A | 3/1990 | Ciani | |
| 5,040,903 | A * | 8/1991 | Schramer | B65D 33/18 206/813 |
| 5,044,776 | A | 9/1991 | Schramer et al. | |
| 5,078,509 | A | 1/1992 | Center et al. | |
| 5,291,625 | A * | 3/1994 | Leslie | A47C 27/081 5/420 |
| 5,353,575 | A * | 10/1994 | Stepanek | B65B 25/023 206/423 |
| 5,824,380 | A * | 10/1998 | Hagen | B32B 3/04 428/41.9 |
| 5,855,434 | A * | 1/1999 | Hagen | B65D 33/1691 383/203 |
| 2002/0114541 | A1* | 8/2002 | Huffer | B65D 33/20 383/89 |
| 2003/0032750 | A1* | 2/2003 | Chang | B32B 7/12 526/348.1 |
| 2004/0058103 | A1 | 3/2004 | Anderson et al. | |
| 2006/0083446 | A1* | 4/2006 | Sampaio Camacho | B65D 33/1691 383/62 |
| 2006/0251341 | A1* | 11/2006 | Sampaio Camacho | B65D 33/165 383/62 |
| 2006/0251342 | A1* | 11/2006 | Forman | B65D 33/1691 383/62 |
| 2011/0019941 | A1 | 1/2011 | Ghazali | |
| 2011/0038569 | A1* | 2/2011 | Huffer | B65D 33/20 383/207 |

* cited by examiner

FLEXIBLE PACKAGE HAVING A RECYCLABLE CLOSURE AND A METHOD OF CONFIGURING SAID PACKAGE FOR RECYCLING

CROSS-REFERENCE TO RELATED APPLICATIONS

This application claims priority under 35 U.S.C. 120, as a non-provisional patent application to Provisional Application 62/039,589, filed Aug. 20, 2014, which is incorporated by reference in its entirety.

FIELD OF THE INVENTION

This invention relates to a flexible package having a recyclable closure and a method of configuring the package for recycling.

BACKGROUND OF THE INVENTION

Currently, material recovery facilities, which handle the separation and recycling of waste material, such as paper, plastic, glass, metal, etc., do not want consumers to recycle flexible plastic packages, especially stand-up pouches used primarily to package food items, even when such packages are made from a single recyclable polymer. The reason for this is that such packages, when empty, acquire a relatively flat, two dimensional shape. In the separation process, three dimensional plastic recyclable objects, such as plastic bottles and plastic caps, are sorted from two dimensional objects, such as sheets of paper, newspaper, etc. by using an inclined conveyor. As the recyclable material is transported up the inclined conveyor, the 3-dimensional plastic objects, i.e. plastic bottles and plastic caps, will roll or fall down to the bottom of the conveyor. However, the two dimensional flat items, such as 8.5×11 inch sheets of paper, newspaper, and the flat plastic packages, especially stand-up pouches, will stay on the conveyor and be transported up and into a storage bind. In this case, the relatively flat plastic packages end up being collected with the paper rather than with the 3-dimensional plastic bottles. This results in the flat plastic packages contaminating the paper.

The need to be able to recycle flat plastic packages, especially stand-up pouches, is a growing concern primarily because of the large quantity of material that is involved. A solution to this problem could reap huge economic rewards and also create an environmentally friendly solution. Flexible plastic packages now represent the fastest growing sector in the packaging industry. Today, a majority of the flexible, stand-up plastic pouches found in the market are made from polyethylene (PE) film (mono or coex) laminated with another material to provide stiffness or other desired properties. Often this other material is polyethylene terephthalate (PET). There are also other structures where polypropylene (PP) and/or aluminum foil, and/or polyamides (nylon) are used. All of these materials are capable of being recycled.

It should be noted that flexible, stand-up plastic pouches made from multi-polymer films are not currently recyclable. However, there has been a concerted effort by resin manufacturers to develop a single polymer film for use in the production of flexible plastic packages that has the potential to be recycled. As of today, Dow Chemical Company has developed a single polymer film for use in making flexible, stand-up plastic pouches and has filed for patent protection. However, the above described problem of sorting such empty stand-up pouches from relatively flat sheets of paper and newspapers still remains.

Now, a flexible package having a recyclable closure has been invented which facilitates the separation of relatively flat flexible packages, especially those constructed from plastic, from other flat material, especially paper, on an inclined conveyor belt.

SUMMARY OF THE INVENTION

Briefly, this invention relates to a flexible package having a recyclable closure and a method of configuring the package for recycling. The flexible package includes a front surface, a back surface, an open first end, a closed second end, and a pair of sides joining the open first end to the closed second end to form an enclosure. A closing seal is formed to close the open first end after the enclosure has been filled with a product. The flexible package also has a recyclable closure spaced apart from the closing seal. The recyclable closure has a first end and a second end. The first end is secured to one of the front or back surfaces, whereby once the product has been removed from the enclosure, the flexible package is configured into a 3-dimensional shape. The recyclable closure is used to retain the flexible package in the 3-dimensional shape by positioning the second end of the recyclable closure over the closed second end or over one of the pair of sides of the flexible package and then attaching the second end of the recyclable closure to the same surface to which the first end is secured.

Another embodiment of the flexible package includes a front surface, a back surface, an open first end, a closed second end, and a pair of sides joining the open first end to the closed second end to form an enclosure. A closing seal is formed to close the open first end after the enclosure has been filled with a product. The flexible package also has a resealable closure formed adjacent to the closing seal. This resealable closure permits the flexible package to be opened and closed multiple times after the flexible package has been opened approximate the closing seal. The flexible package further includes a recyclable closure spaced apart from the resealable closure. The recyclable closure has a first end and a second end. The first end is secured to one of the front or back surfaces, whereby once the product has been removed from the enclosure, the flexible package is configured into a 3-dimensional shape. The recyclable closure is used to retain the flexible package in the 3-dimensional shape by extending the second end of the recyclable closure over the closed second end or over one of the pair of sides of the flexible package and then attaching the second end of the recyclable closure to the same surface to which the first end is secured.

This invention also includes a method of configuring a flexible package for recycling. The flexible package includes a front surface, a back surface, an open first end, a closed second end, and a pair of sides joining the open first end to the closed second end to form an enclosure. The flexible package also has a recyclable closure spaced apart from the open first end. The recyclable closure has a first end and a second end. The first end is secured to one of the front or back surfaces. The method includes the steps of filling the enclosure with a product and then forming a closing seal to close the open first end. Later, the flexible package is opened adjacent to the closing seal and the product is removed. The empty flexible package is then configured into a 3-dimensional shape and is retained in this 3-dimensional shape by the recyclable closure. The recyclable closure is opened so that it extends over the closed second end or over one of the pair of sides of the flexible package. The second end of the resealable closure is then attached to the same surface of the flexible package to which the first end is secured. The 3-dimensional shape facilitates recycling the flexible package at a recycling facility.

The general object of this invention is to provide a flexible package having a recyclable closure which, after the flexible package has been configured into a 3-dimensional shape, will retain the 3-dimensional shape. A more specific object of this invention is to provide a method of configuring the flexible package for recycling.

Another object of this invention is to provide a flexible package with both a resealable closure and a recyclable closure.

A further object of this invention is to provide a flexible package with a recyclable closure which is formed from a polymer which is identical to the polymer used to form the flexible package. Still further, an object of this invention is to provide an economical way to transfigure a relatively flat plastic package into a 3-dimensional shape which can be easily separated from flat objects, especially sheets of paper and newspaper, at a recycling facility.

Other objects and advantages of the present invention will become more apparent to those skilled in the art in view of the following description and the accompanying drawings.

DETAILED DESCRIPTION OF THE INVENTION

Figure 1:
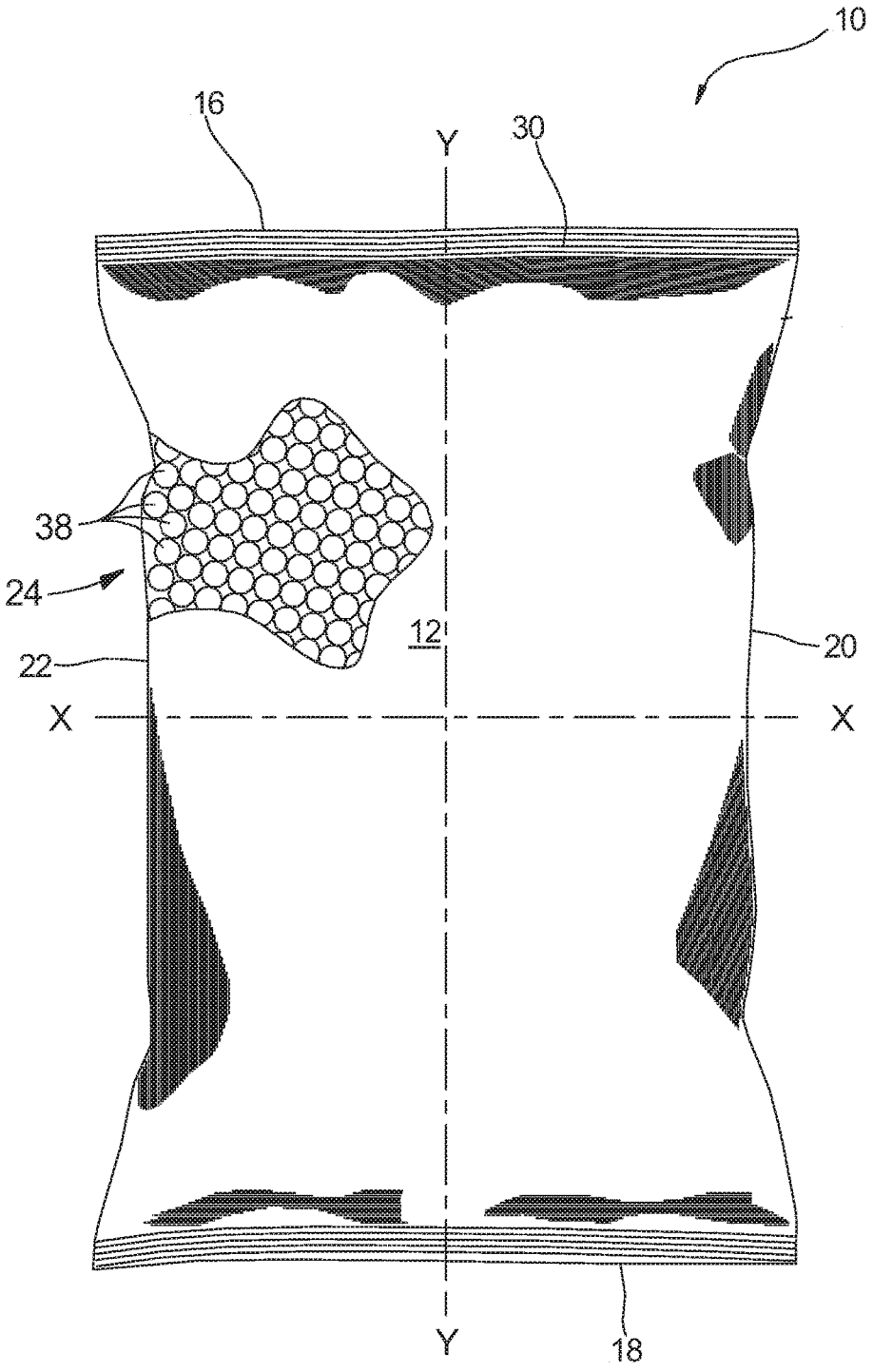
FIG. 1 is a front view of a flexible package having a cut-a-way portion showing the products retained therein.
Figure 2:
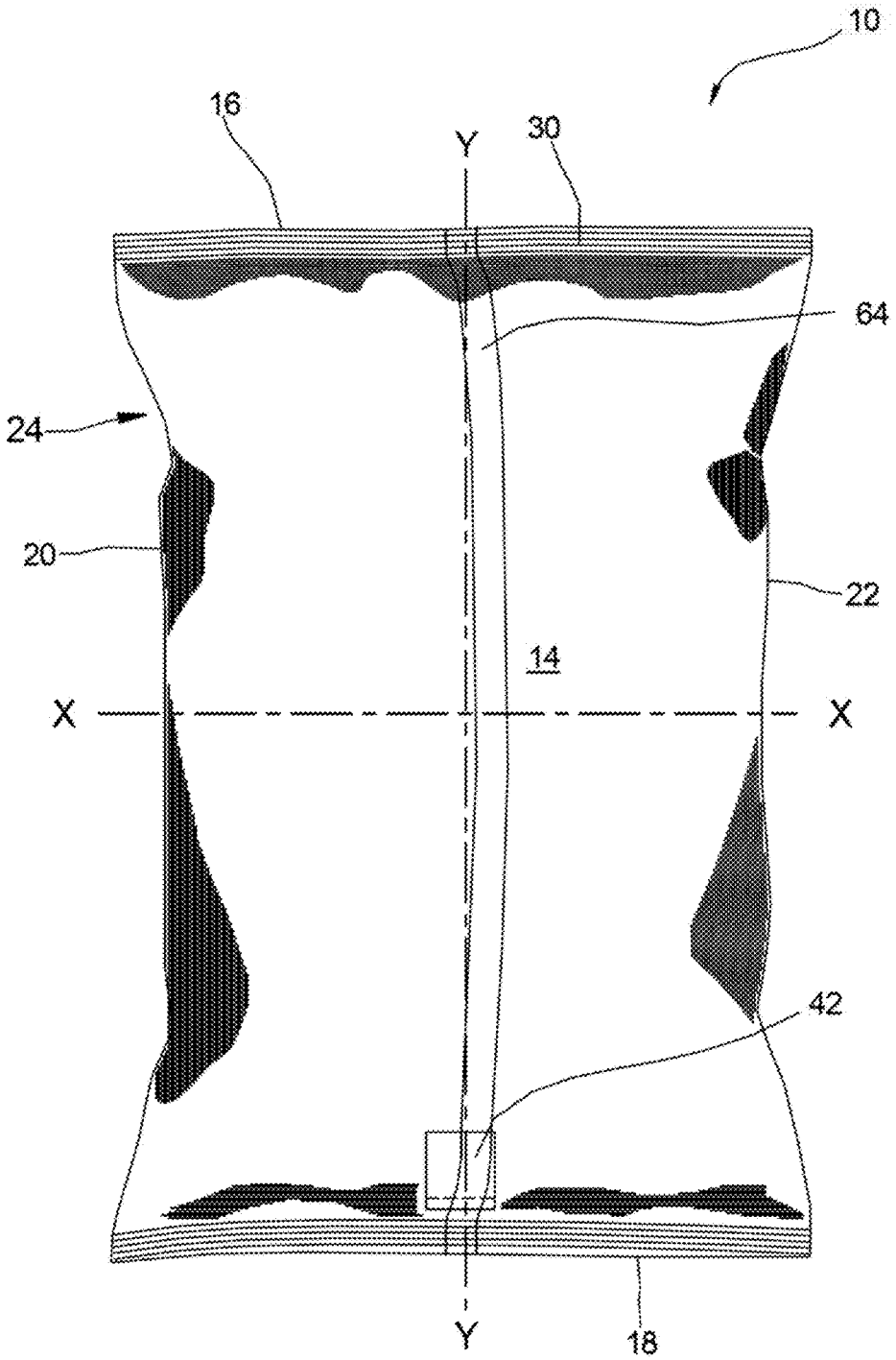
FIG. 2 is a back view of the flexible package shown in FIG. 1.

Referring to FIGS. 1 and 2, a flexible package 10 is shown having a longitudinal central axis X-X, a vertical central axis Y-Y and a transverse central axis Z-Z. The flexible package 10 can vary in size, design, configuration and construction. The flexible package 10 may or may not have a gusseted bottom so that it can be vertically oriented. However, the flexible package 10 can be any form of package known to those skilled in the art.

The flexible package 10 can be constructed from a variety of different materials. The flexible package 10 can be formed from a single material or be formed from two or more materials. A desirable material from which the flexible package 10 can be formed is plastic. By "plastic" it is meant any of various organic compounds produced by polymerization and capable of being molded, extruded, cast into shapes and films, or drawn into filaments. The plastic can be made from a single polymer which has been extruded into a thin pliable film or sheet. Alternatively, the plastic could be made from a copolymer, from two or more different polymers, from a thermoplastic material, etc. By "polymer" it is meant any of numerous natural or synthetic compounds of usually high molecular weight consisting of repeated linked units, each of a relatively light and simple molecule. By "copolymer", it is meant a polymer of two or more different monomers. By "monomer" it is meant a molecule that can be combined with other to form a polymer. Polyethylene (PE) and polypropylene (PP) are two polymers that are widely used today to make flexible packages 10. By "polyethylene" it is meant a polymerized ethylene resin, used especially for containers, kitchenware and tubing or in the form of films and sheets for packaging. By "polypropylene" it is meant any of various thermoplastic resins that are polymers of polypropylene and are used to make molded articles, fibers and fabrics.

The flexible package 10 can also be formed from two or more different materials that are laminated together to produce a flexible package 10 with certain desirable characteristics. For example, a thin layer of aluminum can be laminated to the plastic to provide an air barrier. An air barrier is beneficial when the flexible package 10 is used to store food items. By "laminate" it is meant having two or more layers. In addition, the outer layer could be formed from a material that can be easily printed with letters, numbers, words, text, graphics, symbols, icons, etc. while an inner layer prevents the ink used to print the outer layer from seeping through and contaminating the food items housed in the flexible package 10. Since many flexible packages 10 are used to house food items, it is important that the food item remain pure and clean.

It should also be noted that many flexible packages 10 are formed from relatively thin thermoplastic films that are shipped to a customer in roll form. By "thermoplastic film" it is meant a film formed from one or more thermoplastic resins. A customer may be able to cut and shape the thermoplastic film into packages and then fill the packages 10 with a product. The filled packages 10 are then sealed. The formation, filling and sealing of a package can be done in one continuous operation. The thickness of the film can vary to suit one particular needs.

Still referring to FIGS. 1 and 2, the flexible package 10 includes a front surface 12, see FIG. 1, and a back surface 14, see FIG. 2, which are oppositely aligned to one another. The front surface 12 has an outer periphery, and the back surface 14 has an outer periphery which is contiguous with the outer periphery of the front surface 12. By "contiguous" it is meant sharing an edge or boundary.

In addition, when a flexible package 10 is formed, the front surface 12 will have an initial surface area and the back surface 14 will have an initial surface area. The initial surface area of the front surface 12 will be essentially equal to, if not identical to, the initial surface area of the back surface 14. The flexible package 10 also has an open first end 16, a closed second end 18, and a pair of sides 20 and 22 which join the open first end 16 to the closed second end 18 to form an enclosure 24. The flexible package 10 can be formed from a continuous film sheet that is folded as it transgresses from the front surface 12 to the back surface 14.

Figure 3:
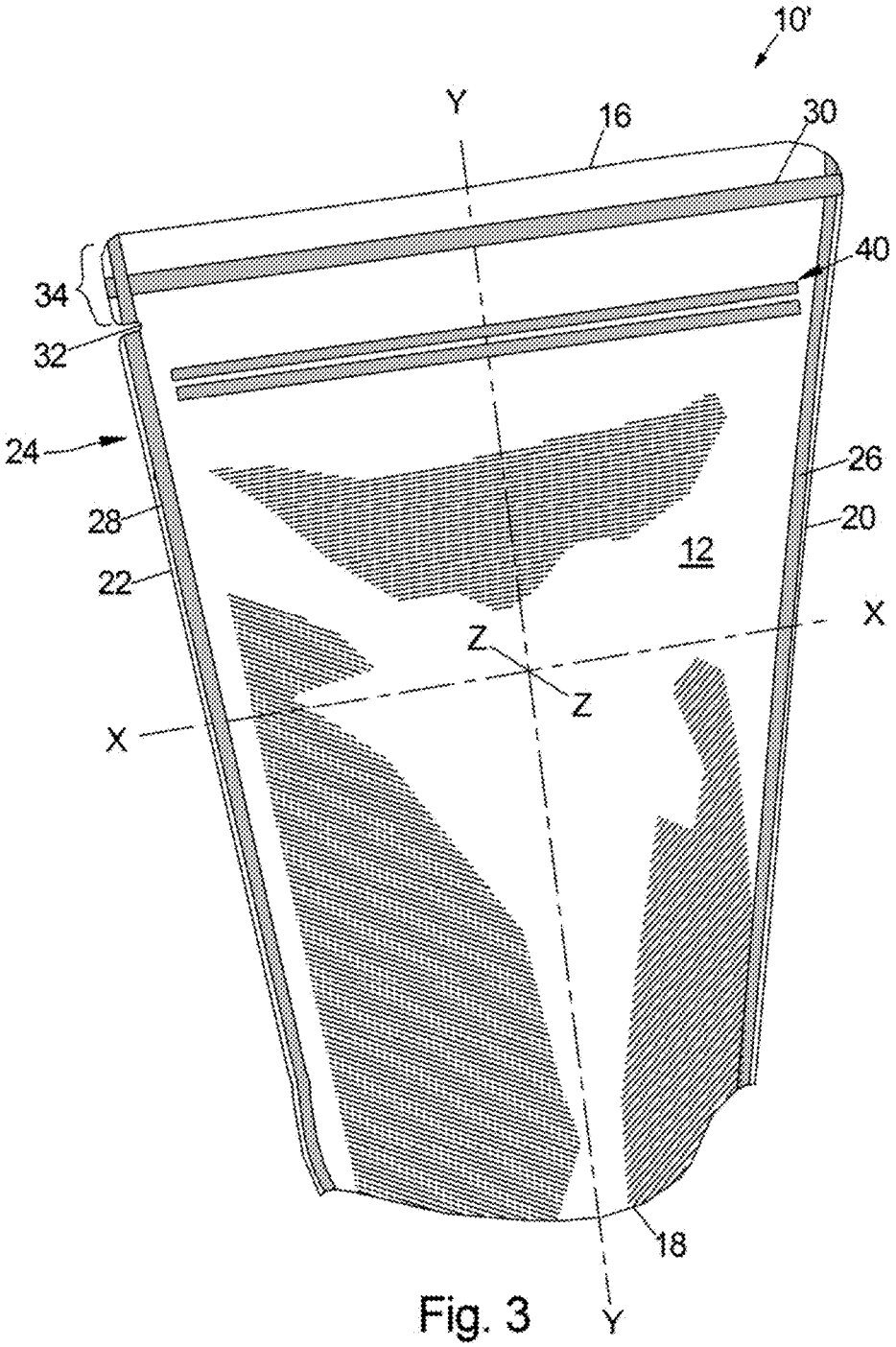
FIG. 3 is a perspective view of another embodiment of a flexible package.
Figure 4:
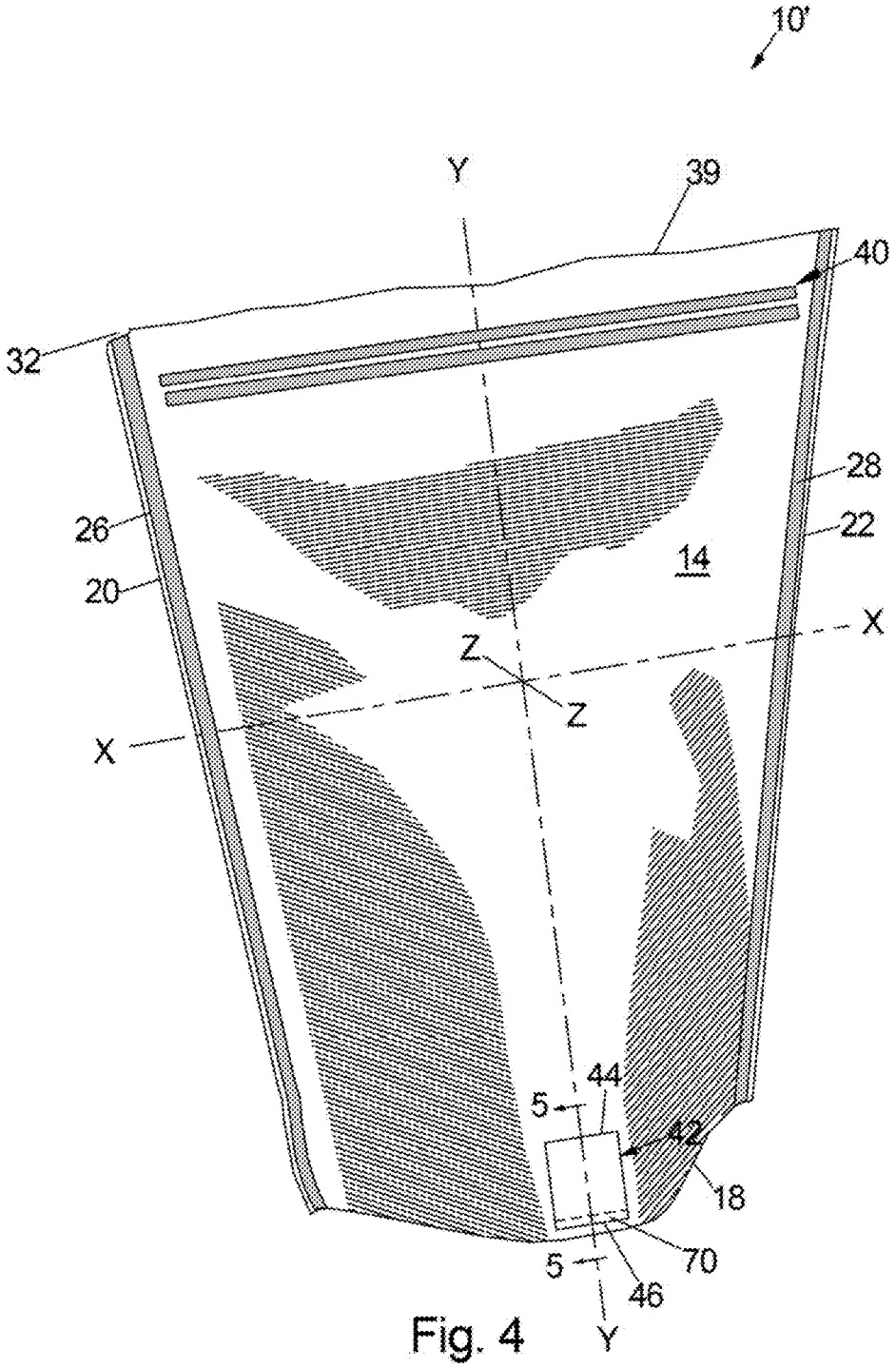
FIG. 4 is a perspective view of the back side of the flexible package shown in FIG. 3 and having the upper portion removed.

Referring to FIGS. 3 and 4, a second embodiment of a flexible package 10' is shown. In this embodiment, the flexible package 10', the pair of sides 20 and 22 contain a side seal, 26 and 28 respectively.

Referring again to FIGS. 1 and 2, a closing seal 30 is formed to close the open first end 16 after the enclosure 24 has been filled with a product 38, see FIG. 1.

Referring again to FIG. 3, the flexible package 10' also includes a tear notch 32 formed in one of the pair of sides 20 or 22. The tear notch 32 can partially extend inward through one of the pair of side seals 26 or 28 so as to facilitate removal of an upper portion 34 of the flexible package 10'. In other words, the tear notch 32 provides an easy and quick method of opening the flexible package 10'. The tear notch 32 can vary in size and shape. For example, the tear notch 32 can have a triangular configuration. The tear notch 32 is located below the closing seal 30. It should be understood that a pair of tear notches 32, 32 can be utilized, if desired.

The portion of the flexible package 10' situated between the first end 16 and the location of the tear notch 32 is herein referred to as the upper portion 34. The upper portion 34 includes the closing seal 30. The upper portion 34 is designed to be completely torn away starting at the tear notch 32. By laterally tearing the upper portion 34 away from the remainder of the flexible package 10', parallel to the longitudinal central axis X-X, one can gain access to the enclosure 24. The upper portion 34 is discarded once it is torn away from the flexible package 10'.

Referring now to FIG. 4, the flexible package 10' is shown after the upper portion 34 has been torn away to provide an opening 39 into the flexible package 10'. The opposite, closed second end 18 of the flexible package 10' is permanently sealed when the flexible package 10' is formed. By "permanent seal" it is meant that this seal is not designed to be broken or compromised in the normal usage of the flexible package 10'. Likewise, depending on the construction of the flexible package 10', the pair of sides 20 and 22 will either consist of a film or sheet of material that is folded upon itself to establish the sides 20 and 22. Alternatively, each of the pair of sides 20 and 22 will contain a permanent side seal, 26 and 28 respectively, as shown. The pair of sides 20 and 22 and the side seals 26 and 28 are permanent and are not designed to be broken or compromised in the normal usage of the flexible package 10'.

Figure 5:
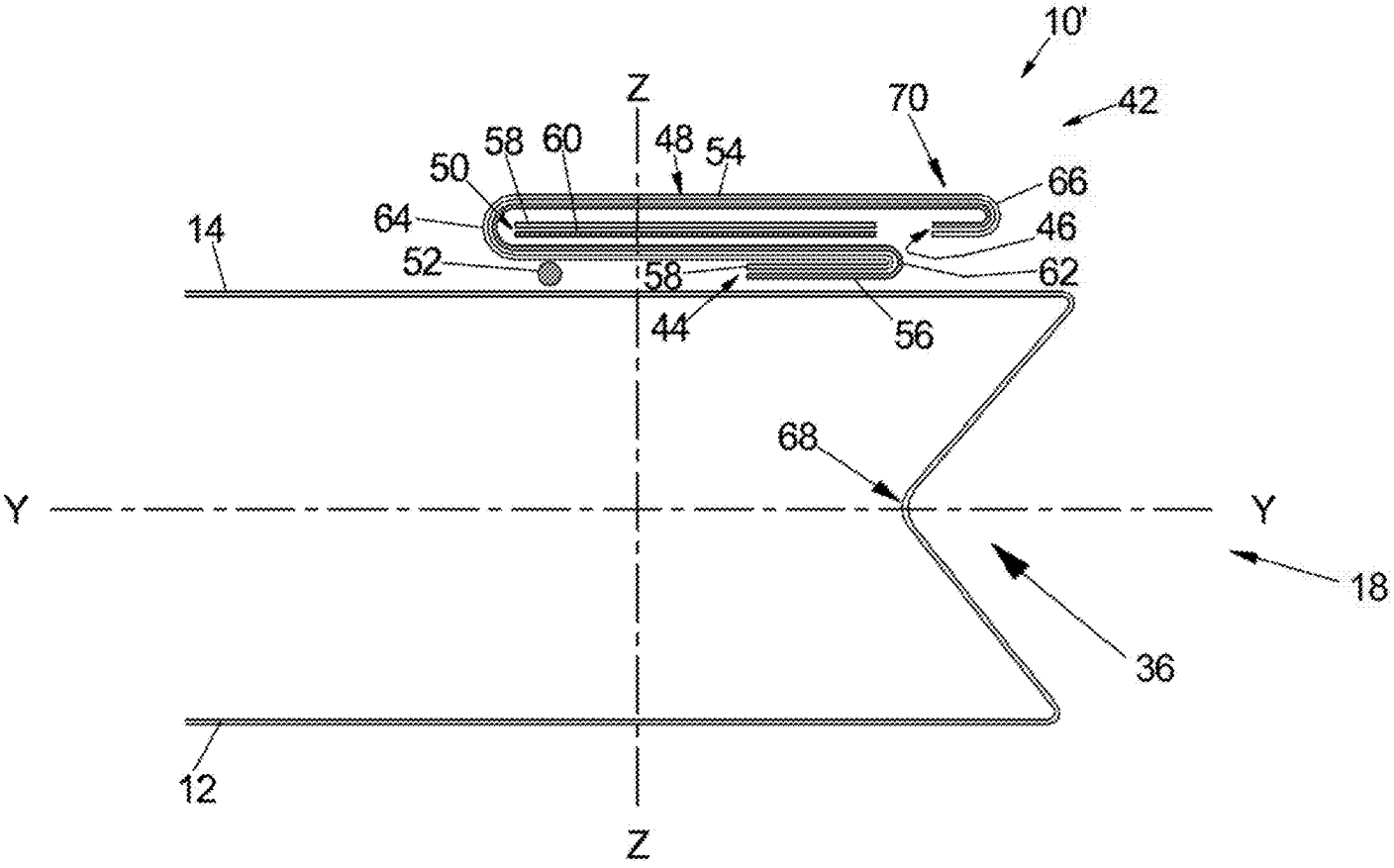
FIG. 5 is a cross-sectional view of the recyclable closure taken along line 5-5 of FIG. 4.

Referring now to FIG. 5, the closed second end 18 or bottom of the flexible package 10' contains a gusset 36. By "gusset" it is meant a triangular insert, as in the seam of a package, for added strength or expansion. The gusset 36 allows the flexible package 10' to stand upright when filled with a product 38. The expansion of the gusset 36 creates an approximately horizontal surface at the closed second end 18. The horizontal surface is aligned parallel to the longitudinal central axis X-X.

It should be understood that the closed second end 18 does not have to contain a gusset 36. Many flexible packages do not contain a gusset 36 at the first or second ends, 16 and 18 respectively. Likewise, a common pillow package, as shown in FIGS. 1 and 2, does not contain a gusset 36.

Referring again to FIG. 1, the product 38 housed in the flexible package 10 or 10' can vary in size, dimension, shape, configuration, type, composition, etc. The product 38 can be a solid, a semi-solid, a liquid or even a gas or vapor. By "solid" it is meant of definite shape and volume; not liquid or gaseous. By "semi-solid" it is meant intermediate in properties, especially in rigidity, between solids and liquids. By "liquid" it is meant a state of matter characterized by a readiness to flow, little or no tendency to disperse, and relatively high incompressibility. By "gas" it is meant the state of matter distinguished from the solid and liquid states by relatively low density and viscosity and the spontaneous tendency to become distributed uniformly throughout any container. By "vapor" it is meant barely visible or cloudy diffused matter, such as mist or smoke, suspended in air; a gas that is below its critical temperature and can be liquefied by pressure.

In FIG. 1, the product 38 is depicted as a plurality of solid, circular items each having an identical profile and size. Alternatively, the plurality of products 38 could vary in size, dimension, shape, composition, etc. The product 38 can be a single item or two or more items. When a plurality of products 38 is housed in the enclosure 24, the products 38 can be identical to one another. Alternatively, some of the products 38 could be different from some of the other products 38. For example, the product 38 could be mixed vegetables consisting of multiple pieces of broccoli, carrots, cauliflower, etc.

The product 38 can be a natural product, a manmade product, a synthetic product, etc. The single product 38 or the plurality of products 38 housed in the flexible package 10 or 10' can be removed one at a time from the enclosure 24. Alternatively, when a plurality of products 38 is housed in the flexible package 10 or 10', one may desire to remove only a portion of the products 38 from the enclosure 24 while the remaining products 38 are saved and then removed at a later time. For example, one may take out only a few of the products 38 from the flexible package 10 or 10' each time, such that it takes several occasions before the flexible package 10 or 10' is empty.

Referring again to FIGS. 3 and 4, the flexible package 10' can optionally include a resealable closure 40 formed adjacent to the closing seal 30. The resealable closure 40 permits the flexible package 10' to be opened and closed multiple times after the flexible package 10' has been permanently opened. For example, the upper portion 34 of the flexible package 10' can be completely torn way from the remainder of the flexible package 10' using the tear notch 32. A person can hold the majority of the flexible package 10' stationary in one hand while using their other hand to tear the upper portion 34 of the flexible package 10' away, starting at the tear notch 32 to create the opening 39.

The resealable closure 40 may provides an air tight and fluid impervious seal. The resealable closure 40 can vary in kind, type, size and design. A variety of resealable closures 40 are commercially available today which use some kind of a mechanical fastening mechanism. Such resealable closures 40 are well known to those skilled in the packaging art. For example, the resealable closure 40 can be a zip-lock style resealable closure which uses either a single or a pair of engaging members. Alternatively, the resealable closure 40 can be formed with an adhesive closure, a tape closure or a closure utilizing a malleable or bendable wire. Hook and loop fasteners can also be used, if desired.

The resealable closure 40 can be constructed from a single polymer or from two or more polymers. Desirably, the resealable closure 40 is constructed from a single polymer. The type of polymer can vary. Polyethylene (PE) is a desired polymer from which to construct the resealable closure 40. Polypropylene (PP) is a second polymer that can also be used. Ideally, the resealable closure 40 is formed from the same polymer as the flexible package 10 or 10'. It is advantageous to form at least about 50% of the resealable closure 40 from a single polymer. More desirably, it is advantageous to form at least about 75% of the resealable closure 40 from a single polymer. Even more desirably, is advantageous to form at least about 80% of the resealable closure 40 from a single polymer.

Still referring to FIGS. 3 and 4, when the flexible package 10' includes a resealable closure 40, the tear notch 32 should be located between the closing seal 30 and the resealable closure 40. Desirably, the tear notch 32 is located half way between the closing seal 30 and the resealable closure 40. The dimensions of the upper portion 34 can vary depending on the overall size of the flexible package 10'.

Referring again to FIG. 2, the flexible package 10 also includes a recyclable closure 42 spaced apart from the closing seal 30. The recyclable closure 42 can be located adjacent to the closed second end 18 or adjacent to one of the pair of sides 20 and 22. The recyclable closure 42 is shown being coaxially aligned with the vertical central axis Y-Y. However, the recyclable closure 42 could be offset from the vertical central axis Y-Y, if desired. The recyclable closure 42 is shown being situated below the longitudinal central axis X-X. Likewise, the recyclable closure 42 could be situated at or above the longitudinal central axis X-X, if desired.

Referring now to FIGS. 4 and 5, the recyclable closure 42 includes a first end 44 and a second end 46. The first end 44 is secured to one of the front or back surfaces, 12 or 14 respectively. In FIG. 4, the recyclable closure 42 has its first end 44 secured to the back surface 14. The first end 44 can be secured using any kind or type of fastener known to those skilled in the art. For example, the first end 44 can be secured using an adhesive, a co-adhesive, glue, forming a chemical bond, forming a mechanical attachment such as a hook and loop fastener, etc. By "adhesive" it is meant a substance, such as paste or cement that provides adhesion. By "co-adhesive" it is meant an adhesive that is capable of attaching to another adhesive. By "glue" it is meant a strong liquid adhesive obtained by boiling collagenous animals parts such as bones, hides and hooves into hard gelatin and then adding water. By "hook and loop fastener" it is mean a VELCRO like fastener. VELCRO is a registered trademark of Velcro Industries B.V. having an office at Castorweg 22-24 Curacao, Netherlands. In addition, the first end 44 can be secured using heat, pressure, heat and pressure, thermal welding, or any other known means for joining one material to another material. Desirably, the first end 44 is permanently secured to the flexible package 10'.

Once the product 38 has been removed from the enclosure 24, the flexible package 10 or 10' can be configured into a 3-dimensional shape. The 3-dimensional shape can be a hollow cylinder, a bi-folded shape, a tri-folded shape, an irregular shape, etc. The recyclable closure 42 is used to retain the flexible package 10' in the 3-dimensional shape for an indefinite period of time so as to facilitate recycling. At a recycling facility, 3-dimensional articles are easily separated from flat objects, such as from 8.5×11 inch sheets of paper and from flat newspaper, on an inclined conveyor belt. By reconfiguring the empty flat, flexible package 10' into a 3-dimensional configuration, and retaining it in this shape, the recycling process is greatly enhanced. This will encourage more recycling facilities to accept and recycle flexible packages 10'.

The recyclable closure 42 can retain the flexible package 10' in a 3-dimensional shape by positioning the second end 46 of the recyclable closure 42 over the closed second end 18, or over one of the pair of sides 20 and 22, and then attaching the second end 46 of the recyclable closure 42 to the same front or back surface, 12 or 14 respectively, to which the first end 44 is secured.

Referring again to FIGS. 2 and 5, the recyclable closure 42 is secured to the flexible package 10' in a closed position. This closed position is referred to as a pre-use configuration.

Returning now to FIG. 5, the recyclable closure 42 includes an attachment tape 48 and a release tape 50. The recyclable closure 42 should be extendible in at least one direction. Desirably, this direction is parallel to the vertical central axis Y-Y when the recyclable closure 42 is designed to bridge across the closed second end 18 of the flexible package 10'. The first end 44 of the recyclable closure 42 is secured to the back surface 14 and is located adjacent to the closed second end 18 of the flexible package 10'. Alternatively, the first end 44 of the recyclable closure 42 can be secured to the front surface 12 of the flexible package 10'.

The recyclable closure 42 can further includes a releasable adhesive 52, if desired. The releasable adhesive 52 can consist of a spot or bead of adhesive, a row of adhesive or an area of adhesive. A bead of the releasable adhesive 52 is depicted in FIG. 5.

The recyclable closure 42 can be formed from a wide variety of materials. The recyclable closure 42 could be formed from an elastic material, a stretchable material, a non-elastic material or from a non-stretchable material. Desirably, the recyclable closure 42 includes an attachment tape 48 constructed of a thermoplastic film layer 54 and having the adhesive layer 56 adhered thereto. The film layer 54 could be formed from the same polymer as was used to form the flexible package 10'. Polyethylene (PE) film is the most common polymer which cart be used. Polypropylene (PP) is a second polymer that can also be used. The adhesive layer 56 can be formed from any commercially available adhesive which has the right properties and peel strength required for this application.

The release tape 50 includes a film layer 58 and an adhesive layer 60. The film layer 58 could be formed from the same polymer as was used to form the flexible package 10 or 10'. Polyethylene (PE) film is the most common polymer which can be used.

Still referring to FIG. 5, the attachment tape 48 further contains first, second and third folds, 62, 64 and 66 respectively. The adhesive 56 of the attachment tape 48, which is located between the first end 44 and the first fold 62, is secured to the back surface 14 of the flexible package 10'. This securement occurs between an inboard edge 68 of the gusset 36 and the closed second end 18. The inboard edge 68 of the gusset 36 extends parallel to the longitudinal central axis X-X and spans across the width of the flexible package 10' from one side 20 to the other side 22.

The adhesive layer 60 of the release tape 50 is laminated to the adhesive layer 56 of the attachment tape 48 in the area between the first and second folds. 62 and 64 respectively. The attachment tape 48 is folded onto itself at the third fold 66 to form a grasping section 70. In addition, the attachment tape 48 can be releasably secured to the back surface 14 of the flexible package 10' with the releasable adhesive 48.

Figure 6:
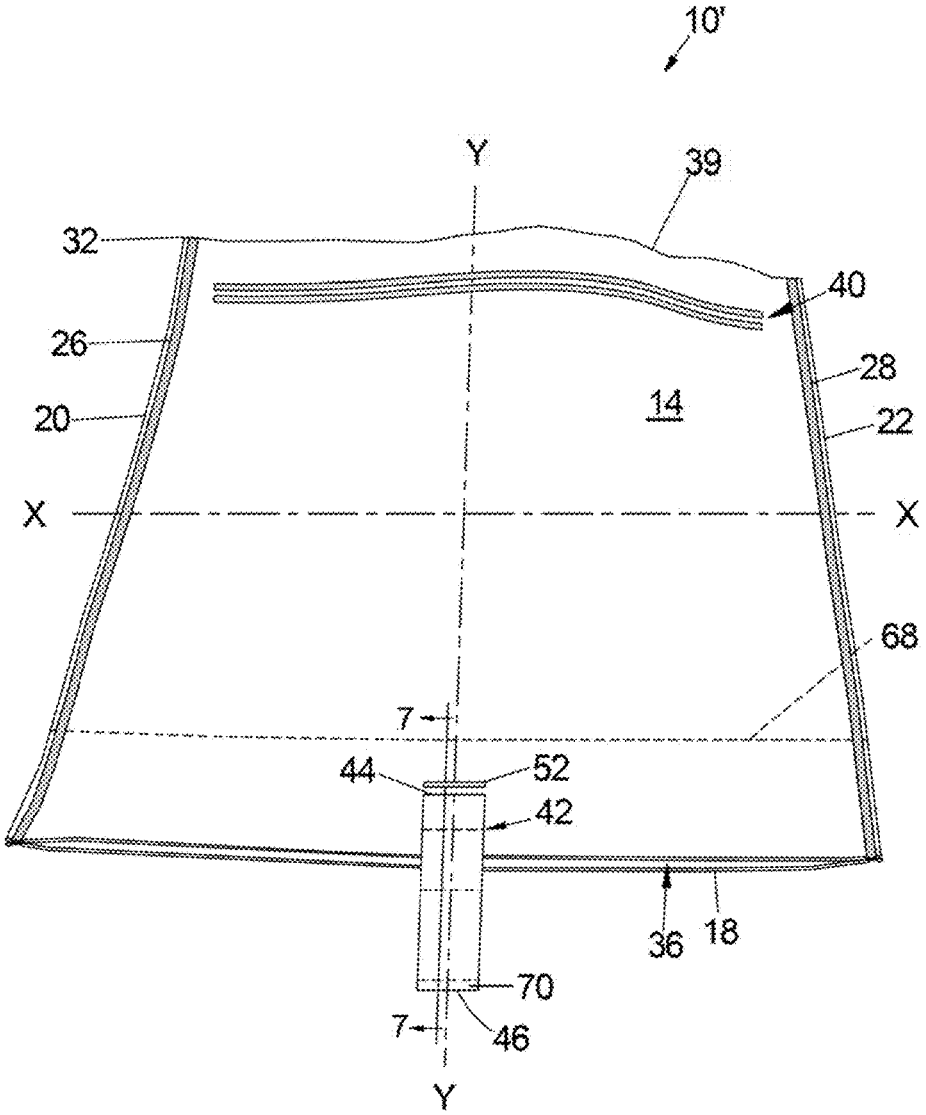
FIG. 6 is a perspective view of the flexible package shown in FIG. 3 with the recyclable closure in an extended position.
Figure 7:
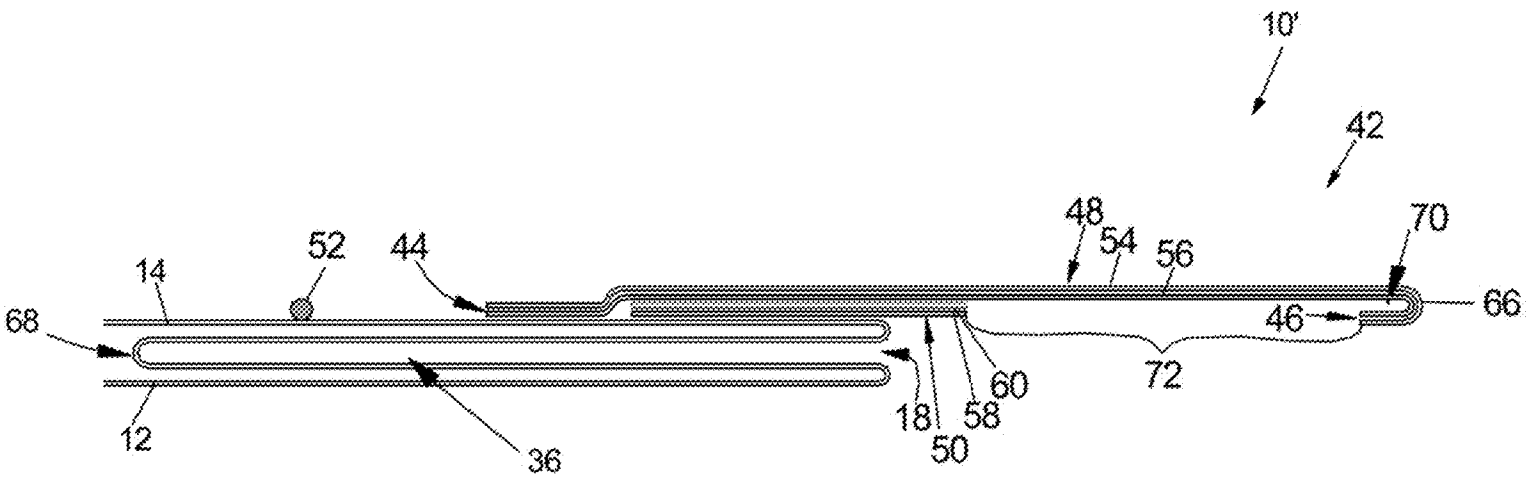
FIG. 7 is a cross-sectional view of the flexible package taken along line 7-7 of FIG. 6

Turning now to FIGS. 6 and 7, the recyclable closure 42 is shown in an extended position. The recyclable closure 42 is moved from the closed position to the extended position when a person grasps the grasping section 70 between his or her thumb and index finger and pulls the recyclable closure 42 downward, in the vertical direction, towards the closed second end 18, parallel to the vertical central axis Y-Y. This pulling action dislodges the attachment tape 48 from the releasable adhesive 52 and also from the film layer 58 of the release tape 50. Desirably, at least a portion of the exposed adhesive layer 56 of the attachment tape 48, located in region 72, see FIG. 7, extends past the closed second end 18 of the flexible package 10'. The exposed adhesive layer 56, in the region 72, should contain an adequate surface area to maintain the flexible package 10' in the 3-dimensional shape. Desirably, the exposed adhesive layer 56, in the region 72, has a surface area of at least about 0.25 square inches. More desirably, the exposed adhesive layer 56, in the region 72, has a surface area of at least about 0.3 square inches. Even more desirably, the exposed adhesive layer 56, in the region 72, has a surface area of at least about 0.4 square inches. Most desirably, the exposed adhesive layer 56, in the region 72, has a surface area of greater than about 0.5 square inches.

It should be understood that it is also possible to secure the recyclable closure 42 within the gusset 36, if desired. In this design, the release tape 50 could be eliminated since the inner portions of the gusset 36 could serve this purpose.

Figure 8:
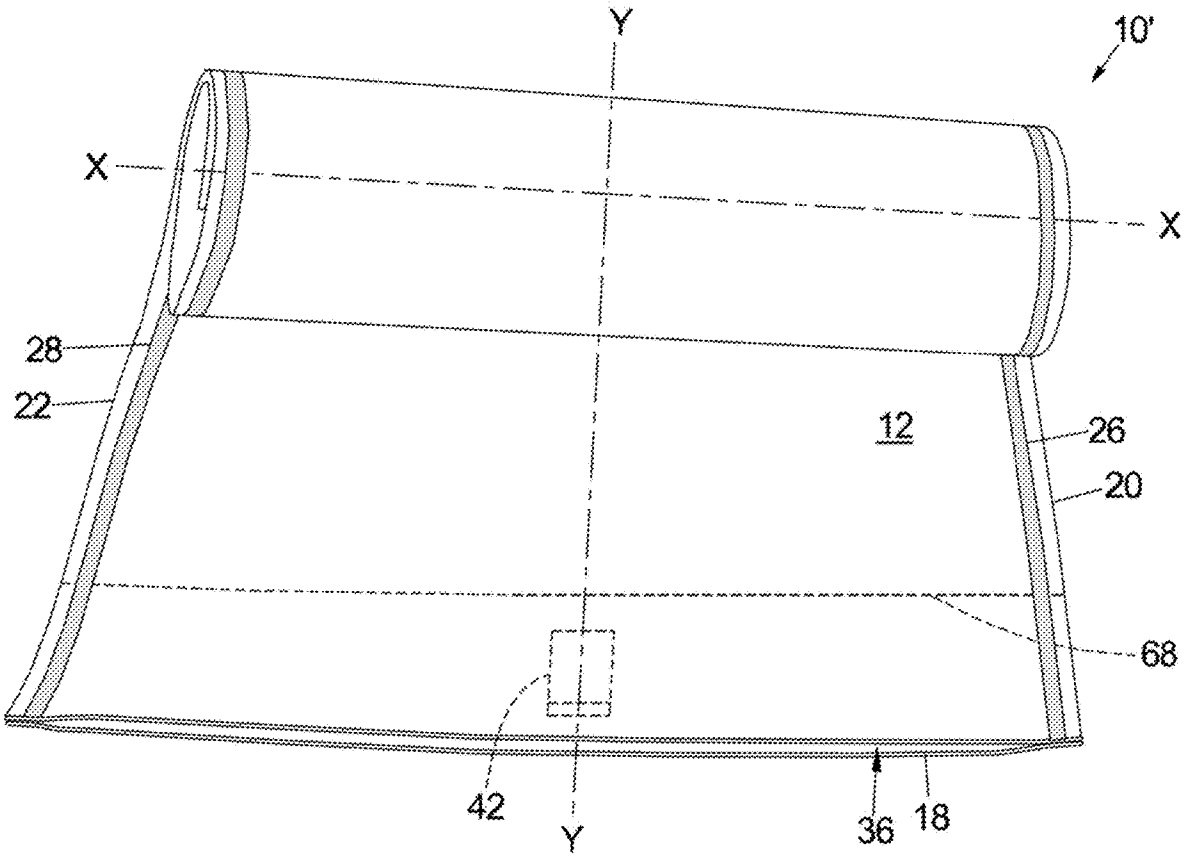
FIG. 8 is a perspective view of the flexible package shown in FIG. 3 partially rolled up into a cylindrical shape.
Figure 9:
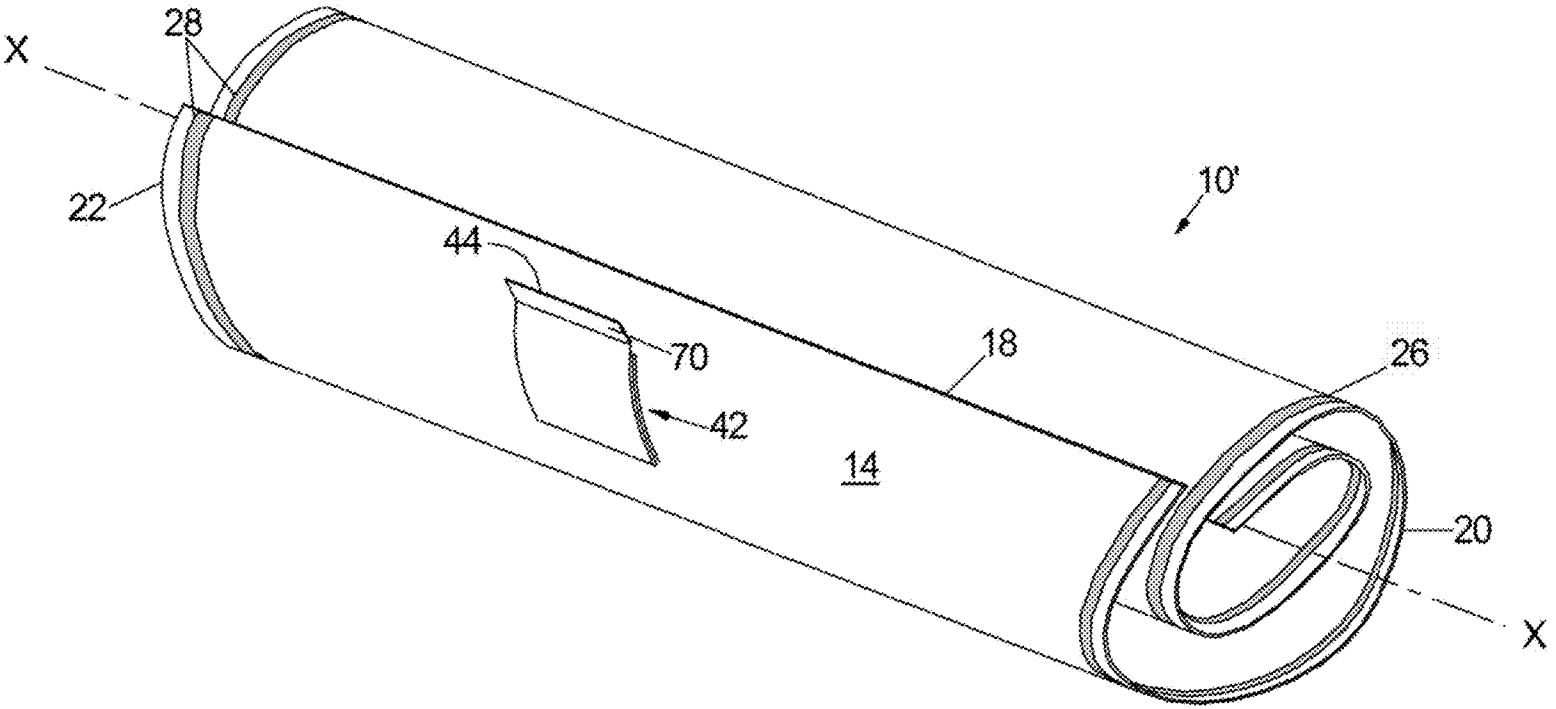
FIG. 9 is a perspective view of the flexible package shown in FIG. 8 after it has been rolled up into a cylindrical shape but before the recyclable closure secures it in this configuration.
Figure 10:
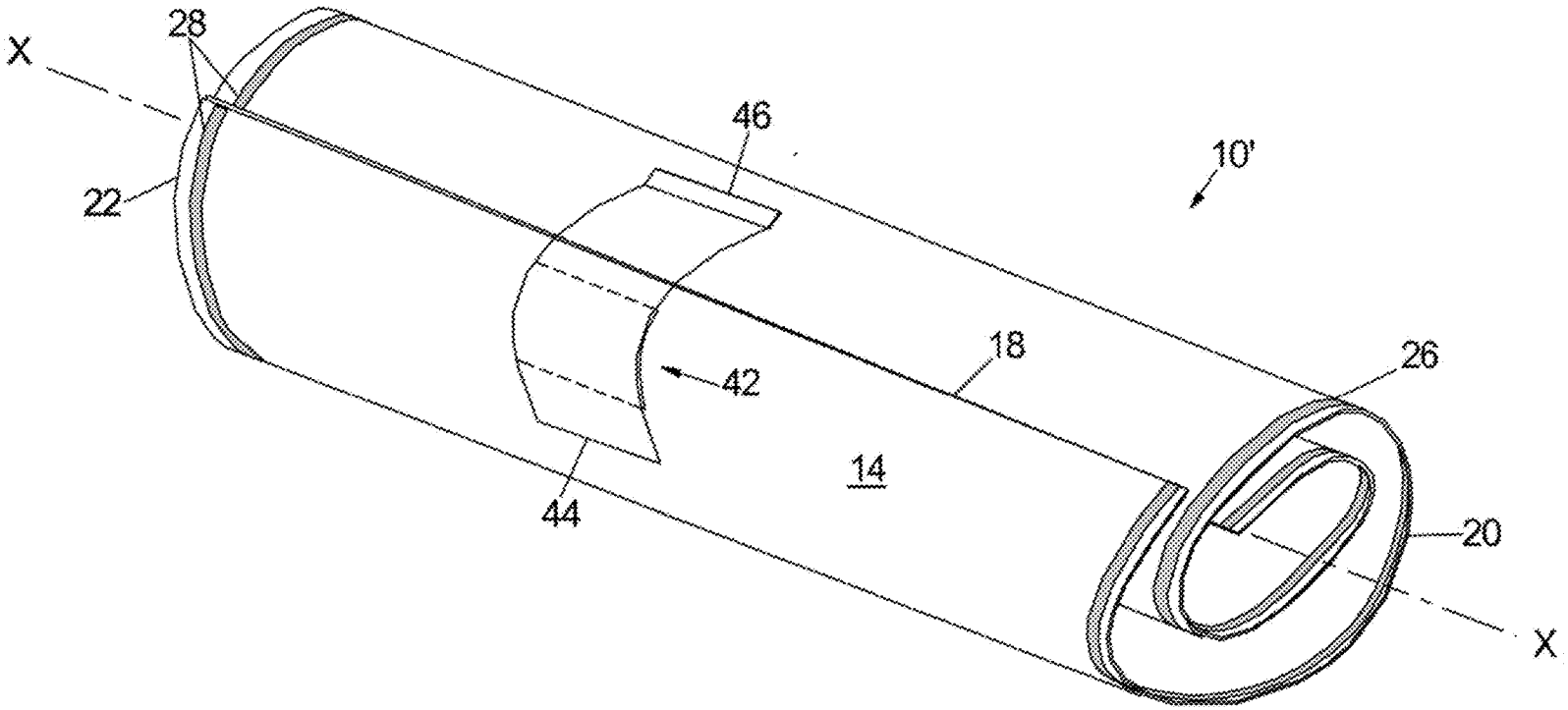
FIG. 10 is a perspective view of the flexible package shown in FIG. 9 after it has been rolled up into a cylindrical shape and the recyclable closure is used to retain it in this 3-dimensional configuration.

Referring now to FIGS. 8-10, the flexible package 10' is shown being rolled up into a cylindrical, 3-dimensional shape for recycling when the recyclable closure 42 is secured to the back surface 14. Starting with FIG. 8, this is accomplished by having a person grab the open first end 16 of the flexible package 10' and roll the front surface 12 unto itself along the vertical central axis Y-Y. FIG. 9 shows the flexible package 10' after it has been rolled up into a hollow tube and with the recyclable closer 42 still in a closed position. The person will then extend the recyclable closure 42 by pulling the second end 46 outward and positioning it across the closed second end 18 of the flexible package 10'. By "extend" it is meant to stretch or spread out to a greater or a fuller length. It is important that the second end 46 of the extended recyclable closure 42 bridges across the closed second end 18, or across one of the pair of sides 20 and 22, of the flexible package 10'. FIG. 10 shows the second end 46 of the recyclable closure 42 in its extended position. The person will then adhere at least a portion of the region 72 of the recyclable closure (see FIG. 7), which contains the exposed adhesive layer 56, to the same back surface 14 to which the first end 44 of the recyclable closure 42 is secured.

Figure 11:
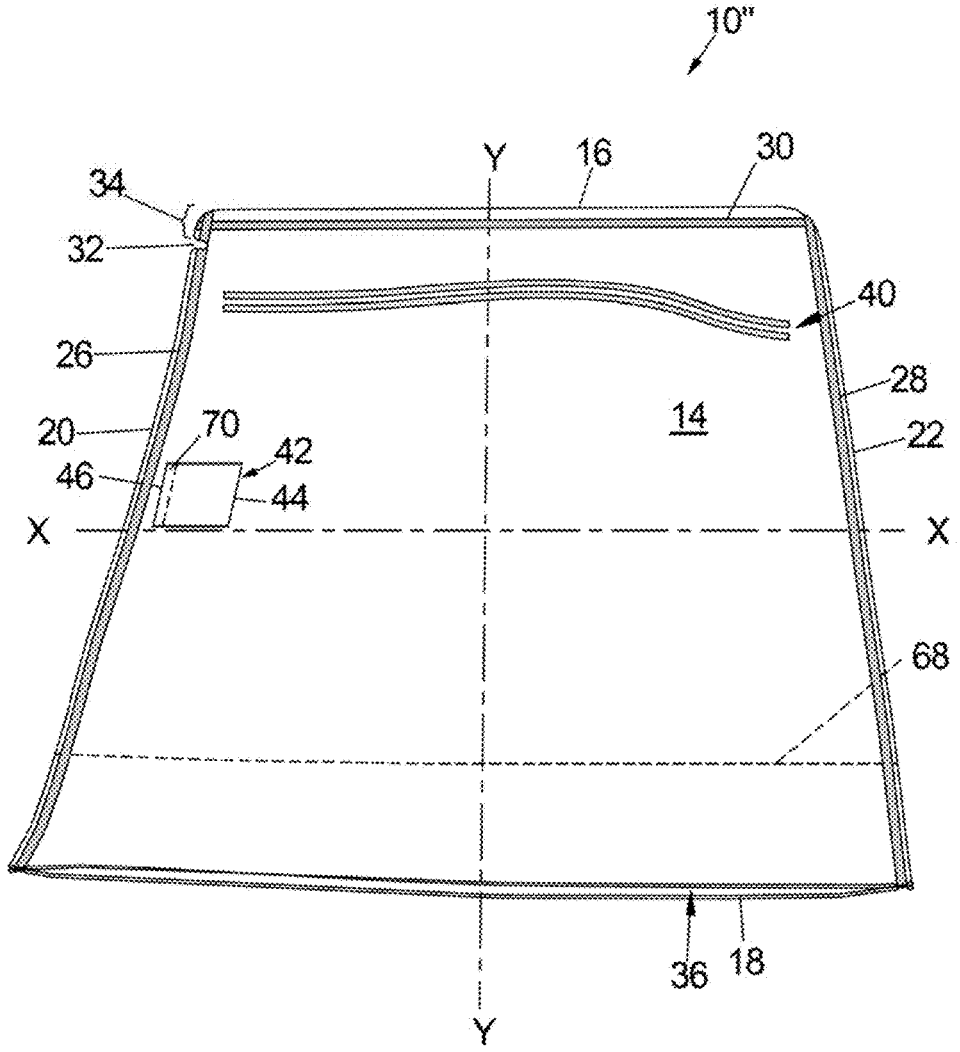
FIG. 11 is a perspective view of a third embodiment of a flexible package having a recyclable closure positioned adjacent to one side.

Referring now to FIG. 11, a third embodiment of a flexible package 10" is shown. All similar components are depicted using the same numbers as where used in FIGS. 1-10. In FIG. 11, the recyclable closure 42 is again secured to the back surface 14 of the flexible package 10". However, in this embodiment, the recyclable closure 42 is positioned adjacent to the permanently sealed side 20 and above the longitudinal central axis X-X. This means that when the recyclable closure 42 is extended to an open position, the second end 46 will bridge across the side 20 and be secured to the same back surface 14 once the flexible package 10" is configured into a 3-dimensional shape. In FIG. 11, the recyclable closure 42 is extended by pulling it sideways, parallel to the longitudinal central axis X-X.

It should be understood that the recyclable closure 42 can be positioned adjacent to one of the permanently sealed sides 20 and 22 or adjacent to the permanently sealed second end 18 for several reasons. First, the recyclable closure 42 is spaced away from the resealable closure 40 to prevent confusion between the two closures, 40 and 42 respectively. Second, the recyclable closure 42 is spaced away from the resealable closure 40 to prevent contamination of the recyclable closure 42 prior to use. Third, the recyclable closure 42 is spaced away from the resealable closure 40 to minimally obscure any product graphics that may appear near the open first end 16 of the flexible package 10, 10' or 10". And fourth, the recyclable closure 42 is spaced away from the resealable closure 40 to position the recyclable closure 42 in a location that reduces the amount of material needed to make an effective seal when retaining the flexible package 10, 10' or 10" in a 3-dimensional shape.

Figure 12:
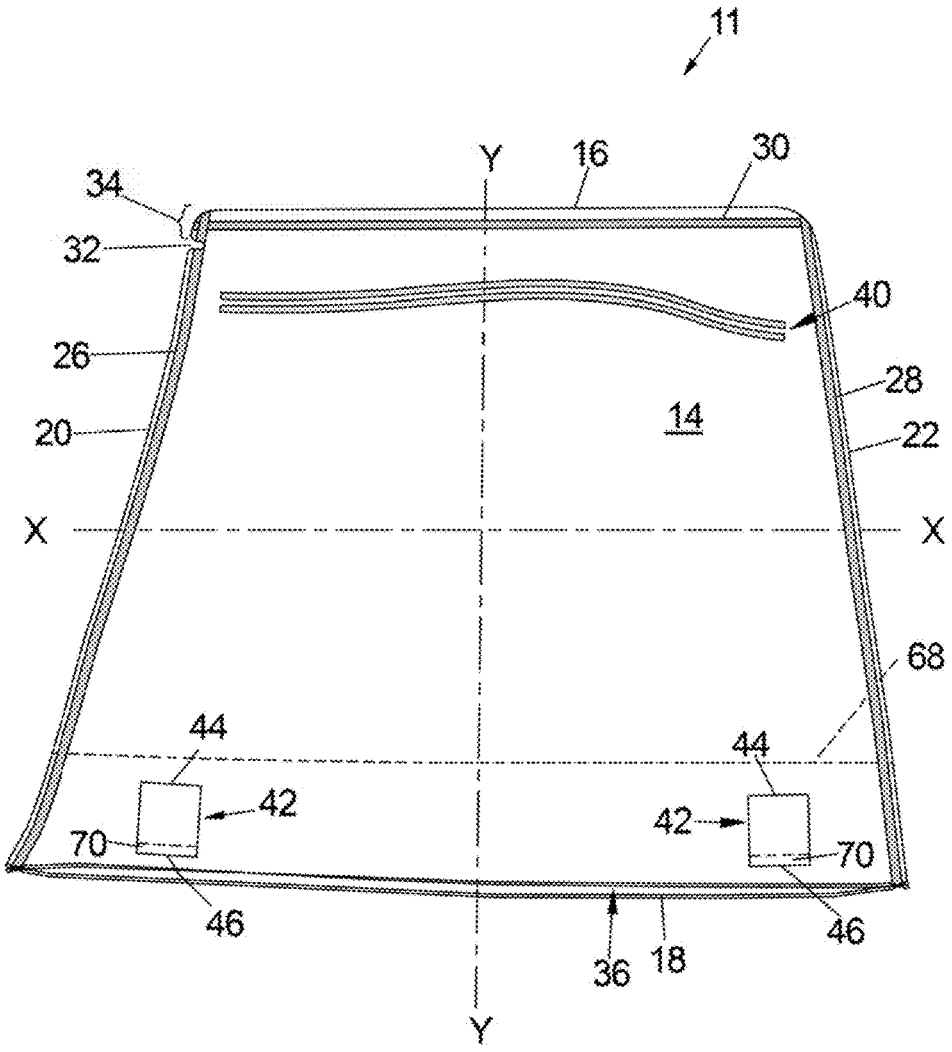
FIG. 12 is a perspective view of a fourth embodiment of a flexible package having a pair of recyclable closures, each positioned adjacent to one of the sides and each located adjacent to the closed second end.

Referring to FIG. 12, a fourth embodiment of a flexible package 11 is shown. In this embodiment, the flexible package 11 includes a pair of spaced apart, recyclable closures 42, 42. The pair of recyclable closures 42, 42 can be spaced apart at various distances depending on the overall size of the flexible package 11. Desirably, the pair of recyclable closures 42, 42 is spaced apart by a distance of at least 2 inches. More desirably, the pair of recyclable closures 42, 42 is spaced apart by a distance of at least 3 inches. Even more desirably, the pair of recyclable closures 42, 42 is spaced apart by a distance of at least 4 inches.

Each of the pair of recyclable closures 42, 42 is positioned adjacent to the closed second end 18 of the flexible package 11. By "positioning" it is meant to place or locate. In addition, each of the pair of recyclable closures 42, 42 is positioned adjacent to one of the sides 20 and 22. Each of the pair of recyclable closures 42, 42 should be spaced at an equal distance from the closed second end 18. In addition, each of the pair of recyclable closures 42, 42 should be spaced at an equal distance from each of the sides 20 and 22. These distances can vary. Desirably, each of the pair of recyclable closures 42, 42 is spaced less than about 2 inches from the closed second end 18. In other words, the second end 46, 46 of each of the pair of recyclable closures 42, 42 should be less than about 2 inches from the closed second end 18. More desirably, each of the pair of recyclable closures 42, 42 is spaced less than about 1 inch from the closed second end 18.

Each of the pair of recyclable closures 42, 42 is positioned such that it can bridge across the closed second end 18. The second end 46 of each of the pair of recyclable closures 42, 42 can be attached to the back surface 14 once the flexible package 11 is configured into a 3-dimensional shape. This is accomplished by having a person grab the open first end 16 of the flexible package 11 and roll the front surface 12 unto itself along the vertical central axis Y-Y. The person will then extend both of the recyclable closures 42, 42 by pulling the second end 46 of each outward and positioning them across the closed second end 18 of the flexible package 11. It is important that the second end 46 of each of the extended recyclable closures 42, 42 bridges across the closed second end 18 of the flexible package 11. The person will then adhere at least a portion of the region 72, see FIG. 7, which contains the exposed adhesive layer 56, to the same back surface 14 to which the first end 44 of each of the recyclable closures 42, 42 is secured.

It should be understood that even though a pair of spaced apart, recyclable closures 42, 42 are present, the flexible package 11 could be retained in its configured 3-dimensional shape by using only one of the two recyclable closures 42, 42. However, since a pair of recyclable closures 42, 42 are present; both should be utilized to obtain a more secure attachment.

Figure 13:
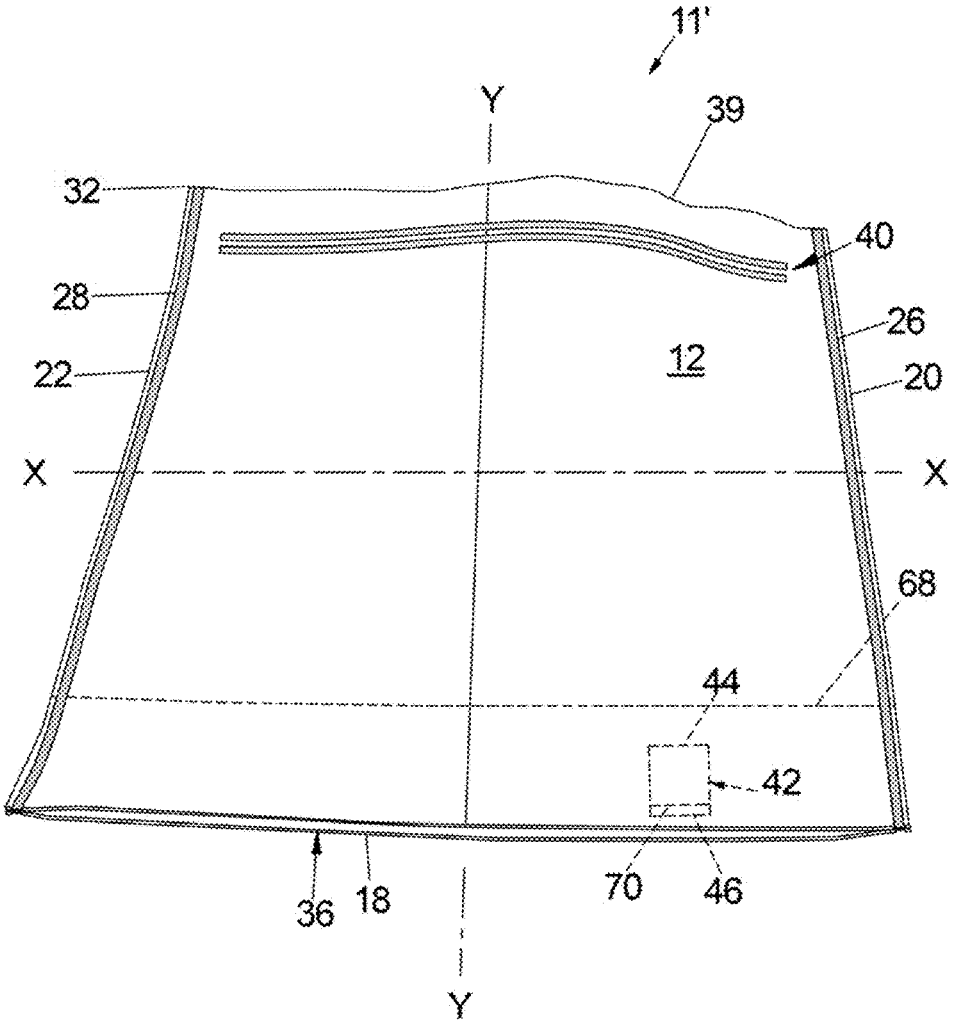
FIG. 13 is a perspective view of a fifth embodiment of a flexible package with the upper portion removed and showing the recyclable closure being offset from the vertical central axis Y-Y.
Figure 14:
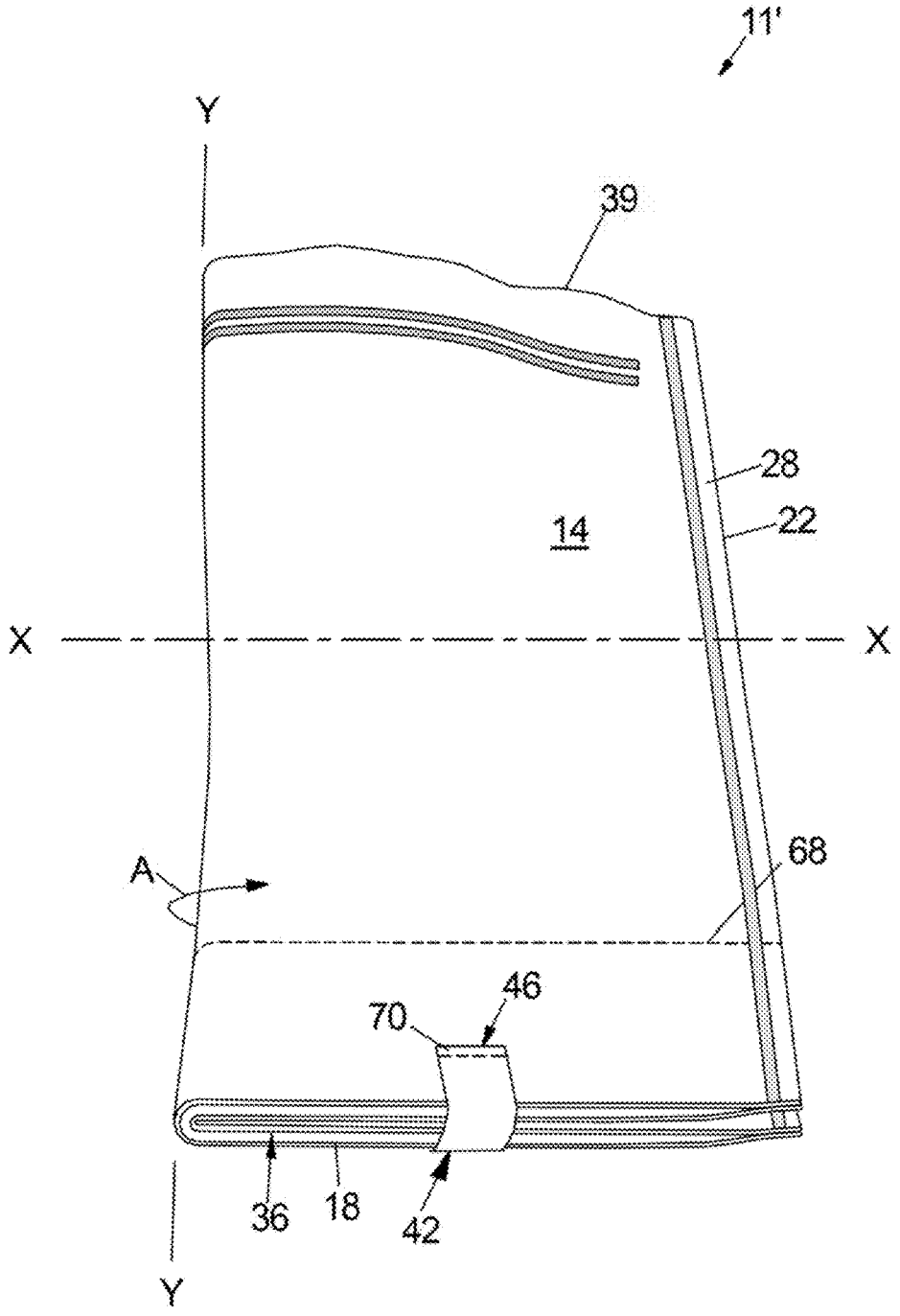
FIG. 14 is a perspective view of the flexible package shown in FIG. 13 after it has been folded once along its vertical central axis Y-Y and showing the recyclable closure bridging across the closed second end and being attached to the back surface.

Referring now to FIGS. 13 and 14, a fifth embodiment of a flexible package 11' is depicted. In this embodiment, a single recyclable closure 42 is utilized which is offset from the vertical central axis Y-Y. The recyclable closure 42 is again secured to the back surface 14 and is positioned adjacent to the closed second end 18 of the flexible package 11'. In FIG. 13, the upper portion 34 of the flexible package 11' has been torn away and the flexible package 11' has been emptied of the product 38 through the opening 39. In FIG. 14, the flexible package 11' has been folded in the direction designated by arrow A, along its vertical central axis Y-Y. The recyclable closure 42 is then extended and wrapped around the closed second end 18. The second end 46 of the recyclable closure 42, and the region 72 which contains the exposed adhesive layer 56, is then attached to back surface 14. The back surface 14 is the same surface to which the first end 44 of the recyclable closure 42 is secured to.

It should be understood that the flexible package 11' could be folded more than once if one desires to obtain a smaller 3-dimensional shape.

Figure 15:
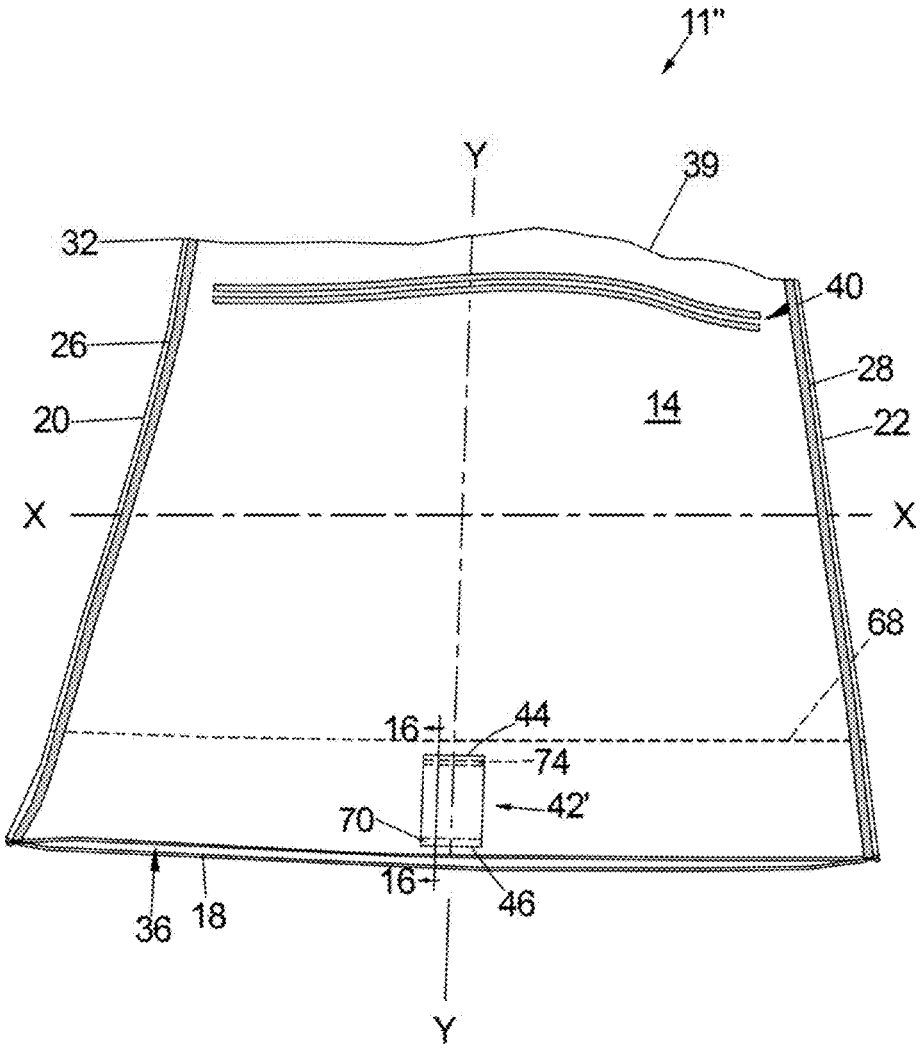
FIG. 15 is a perspective view of a sixth embodiment of a flexible package showing a different configuration for the recyclable closure.
Figure 16:
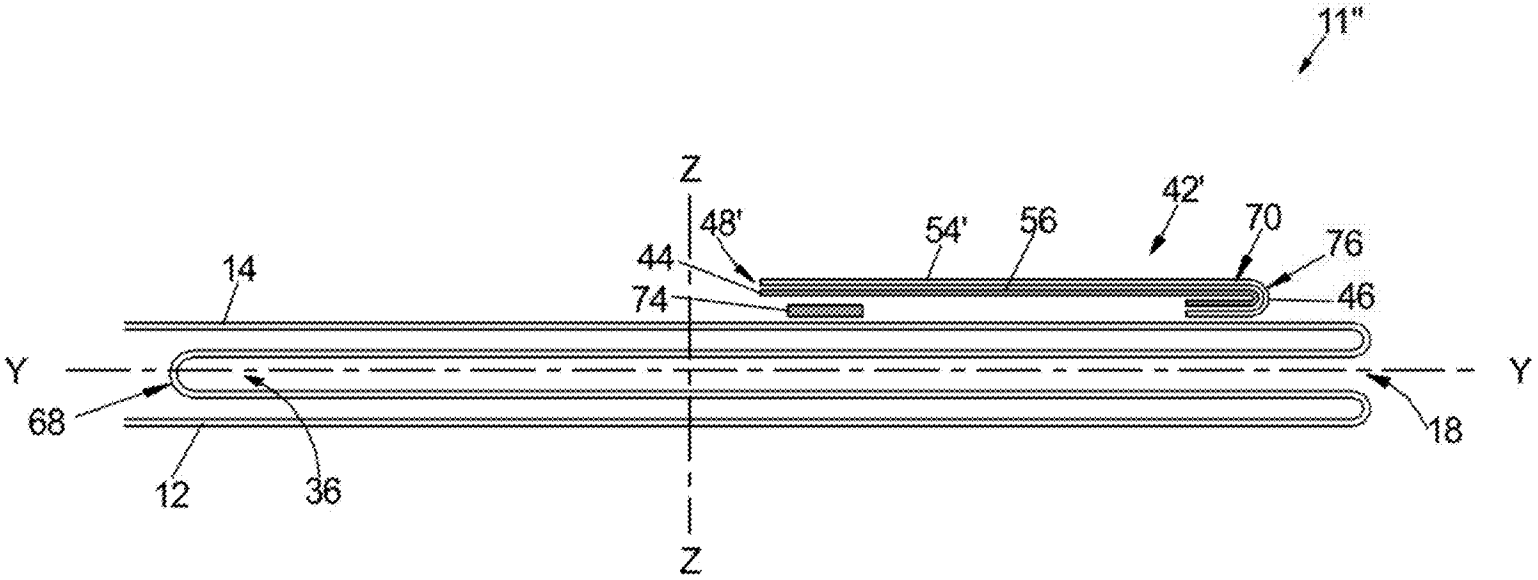
FIG. 16 is a cross-sectional view of the recyclable closure taken along line 16-16 of FIG. 15.
Figure 17:
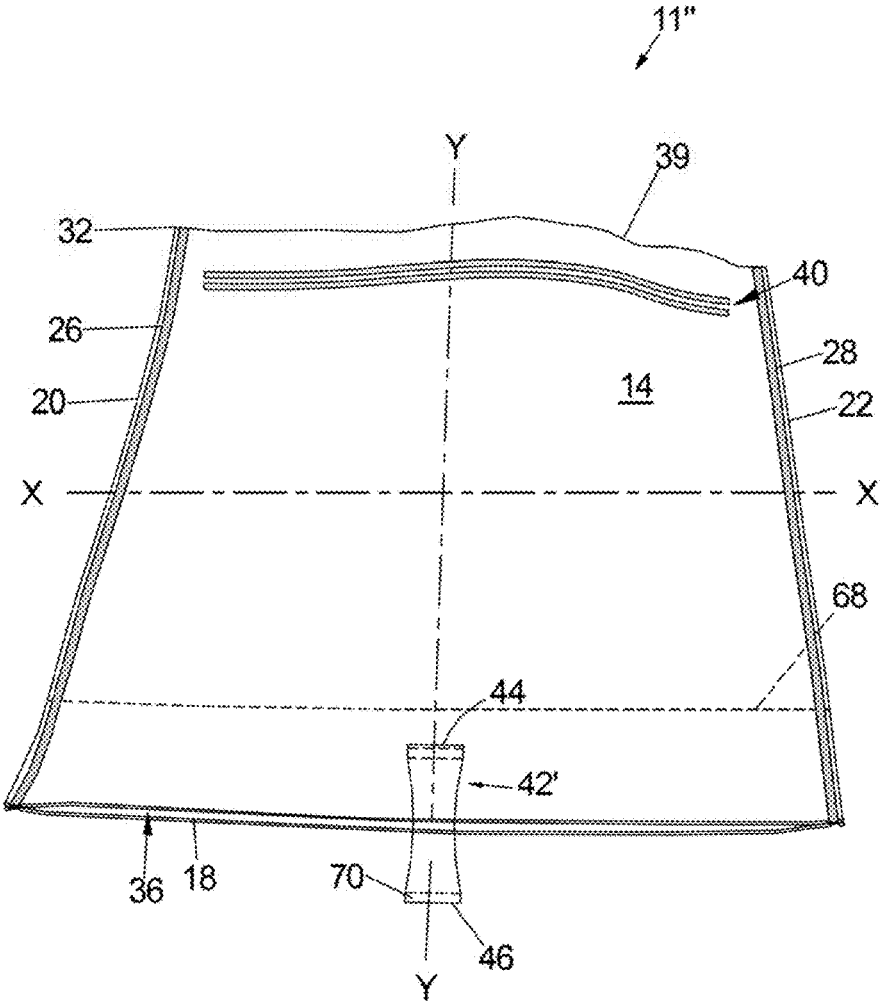
FIG. 17 is a perspective view of the flexible package shown in FIG. 15 with the recyclable closure in an extended position.

Referring now to FIGS. 15-17, a sixth embodiment of a flexible package 11" is depicted. In this embodiment, a recyclable closure 42' is shown which includes an attachment tape 48', see FIG. 16. The attachment tape 48' includes a stretchable film layer 54' and an adhesive layer 56. The stretchable film layer 54' can be constructed from a variety of stretchable material. By "stretchable" it is meant to lengthen or extend. One such material which the stretchable film layer 54' can be constructed from is metalocene polyethylene. The stretchable film layer 54' can also be formed from a material that will neck down and become narrower in width as it extends in length. Such necking materials are well known to those skilled in the art.

Still referring to FIGS. 15 and 16, the recyclable closure 42' is permanently secured at a first end 44 by an adhesive 74 to the back surface 14 of the flexible package 11". The adhesive 74 can be located adjacent to the transverse central axis Z-Z and slightly inboard of the first end 44 of the recyclable closure 42', see FIG. 16.

Still referring to FIG. 16, the recyclable closure 42' also contains a single fold 76 which forms a grasping section 70. The adhesive 56 positioned on the attachment tape 48' is releasably attached to the back surface 14 of the flexible package 11". Desirably, at least a portion of the attachment tape 48' is located between the inboard edge 68 of the gusset 36 and the closed second end 18.

Referring now to FIG. 17, the flexible package 11' is shown in a post-use configuration with the recyclable closure 42' in an extended configuration. The recyclable closure 42' is extended by pulling the second end 46 along the vertical central axis Y-Y. This pulling action dislodges the attachment tape 48' from the back surface 14 and allows it to extend past the closed second end 18 of the flexible package 11". A person can then fold or roll of the flexible package 11" starting at the opening 39 into a configured 3-dimensional shape so that it can be recycled. The second end 46 of the recyclable closure 42' is then bridged across the closed second end 18 and is attached to the back surface 14 via the adhesive 56. This creates a secure attachment which will retain the configured flexible package 11" in its 3-dimensional shape. The 3-dimensional shape facilitates recycling of the flexible package 11" at a recycling center.

The recyclable closure 42' has an initial length measured between the first and second ends, 44 and 46 respectively. The length of the recyclable closure 42' should be capable of being extended by at least about 25%. Desirably, the length of the recyclable closure 42' should be capable of being extended by at least about 50%. More desirably, the length of the recyclable closure 42' should be capable of being extended by at least about 75%. Even more desirably, the length of the recyclable closure 42' should be capable of being extended by at least about 90%. Most desirably, the length of the recyclable closure 42' should be capable of being extended by about 100%.

Figure 18:
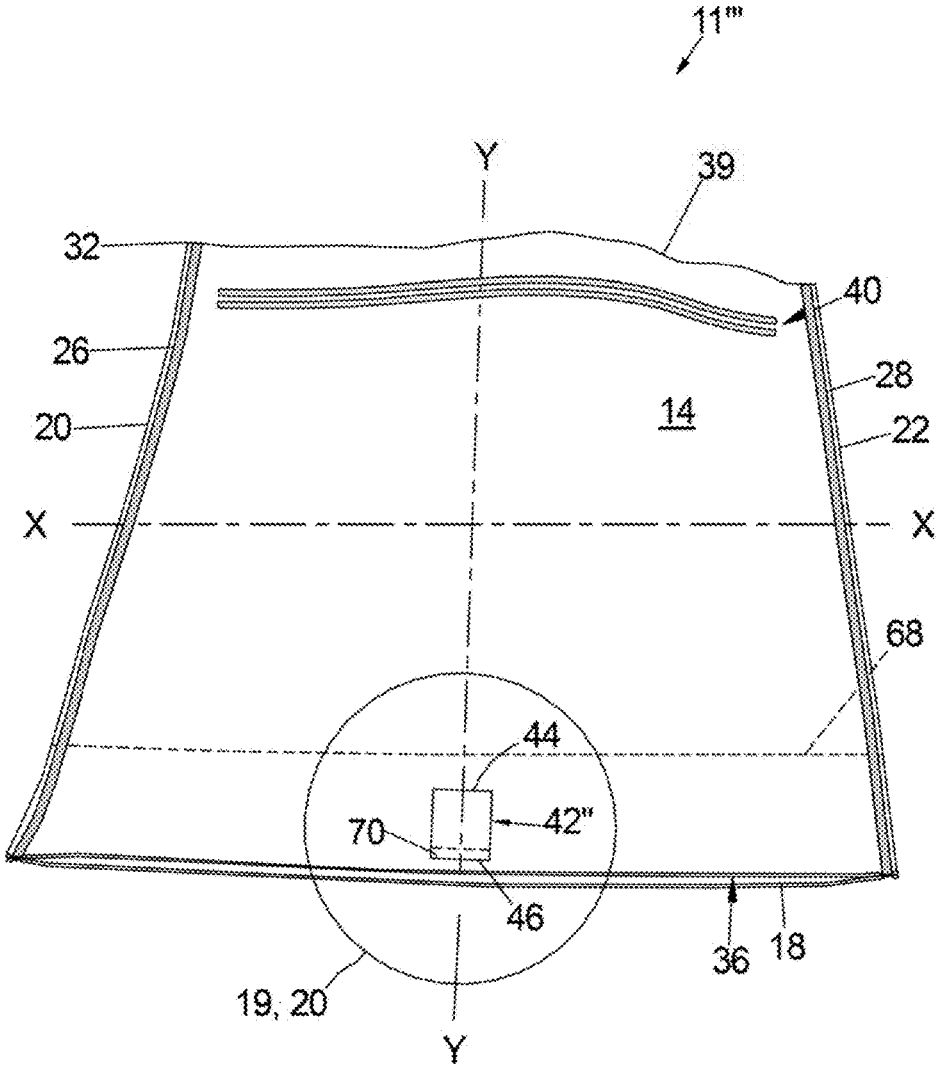
FIG. 18 is a perspective view of the flexible package as was shown in FIG. 4.
Figure 19:
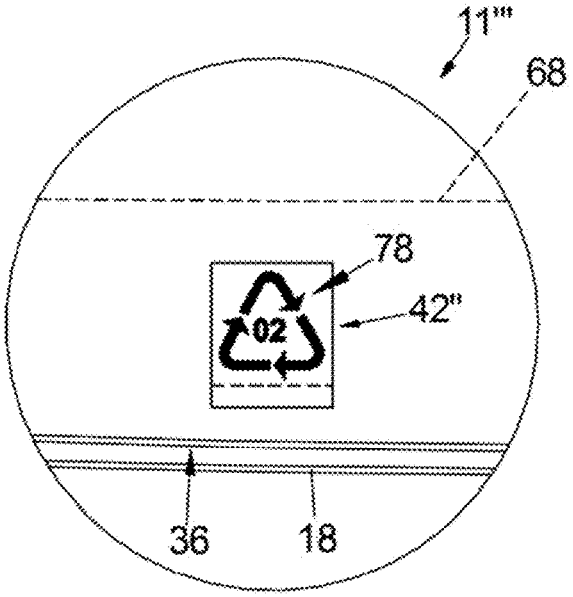
FIG. 19 is an enlarged view of a portion of the flexible package shown in FIG. 18 with indicia being present on the recyclable closure.

Referring now to FIGS. 18-19, a flexible package 11''' is shown which is identical to the flexible package 10' except for the recyclable closure 42". The recyclable closure 42" differs from the recyclable closure 42, shown in FIGS. 1, 2, 4-6, in that it includes indicia 78. By "indicia" it is meant identifying marks, indications, logos, etc. As depicted in FIG. 19, the indicia 78 appear on the recyclable closure 42". The indicia 78 can include letters, numbers, words, text, symbols, icon, designs, logos, geometrical shapes, etc. notifying a person of the type of material from which the flexible package 11''' is constructed, providing instructions on how to configure the flexible package 11''' for recycling, or provide some other useful information. The indicia 78 can be applied directly or indirectly to the recyclable closure 42".

Figure 20:
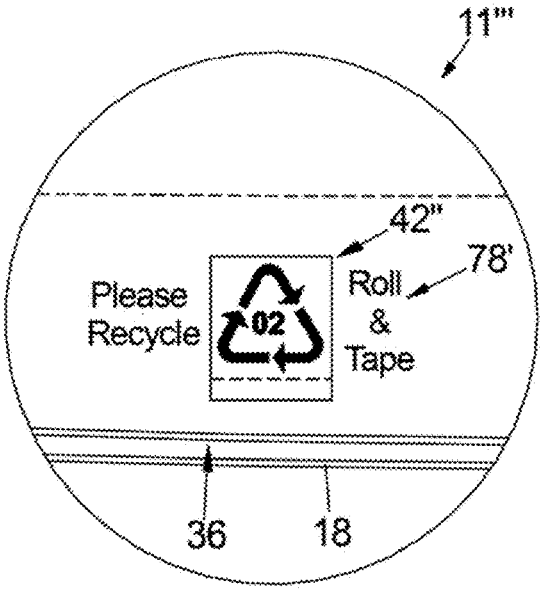
FIG. 20 is an enlarged view of a portion of the flexible package shown in FIG. 18 with indicia and instructions on how to reconfigure the flexible package for recycling, being present adjacent to the recyclable closure.

Referring to FIG. 20, alternatively, indicia 78' can be positioned on the flexible package 11''' and be located adjacent to the recyclable closure 42". The indicia 78' can be located to the left and/or right of the recyclable closure 42". Likewise, the indicia 78' could also appear above and/or below the recyclable closure 42". The indicia 78 can be affixed to the recyclable closure 42". The indicia 78' can appear on the surrounding surface of the flexible package 11''' by any means known to those skilled in the art. For example, the indicia 78 and 78' can be: printed, painted, stenciled, sprayed, embossed, engraved or somehow attached, such as by applying a decal, onto the recyclable closure 42".

Referring again to FIG. 19, the indicia 78 includes a triangular shape having three arrowed segments denoting that the plastic material from which the flexible package 11''' is constructed is recyclable. The number "02" appearing within the triangle, denotes the kind of polymer from which the flexible package 11''' was made.

Referring again to FIG. 20, the words "Please Recycle" appear to the left of the recyclable closure 42" while the words "Roll & Tape" appear to the right of the recyclable closure 42". This added text alerts the consumer that this flexible package 11''' is in fact recyclable. This text also provides instructions to the consumer on how to configure the flexible package 11''' into a 3-dimensional shape for recycling and how to use the recyclable closure 42" (tape) to retain the configured 3-dimensional shape.

The ability to reconfigure the flexible package 10, 10', 10", 11, 11', 11" and 11''' into a 3-dimensional shape certainly facilitates recycling the material from which the flexible packages 10, 10', 10", 11, 11', 11" and 11''' is formed. In order to improve the sorting efficiency of the material recovery process, it may be desirable to reduce the foot print or maximize the projected two dimensional area of a flexible package 10, 10', 10", 11, 11', 11" and 11'''. For example, a 9 inch by 9 inch flat, flexible package 10, 10', 10", 11, 11', 11" and 11''' has a Maximum Projected 2-Dimensional Area (MP2DA) of 81 square inches (9 inches×9 inches=81 square inches) when empty. By folding the flexible package 10, 10', 10", 11, 11', 11" and 11''' in half, one can obtain a new Maximum Projected 2-Dimensional Area (MP2DA) of 40.5 square inches (4.5 inches×9 inches=40.5 square inches). This represents a 50% reduction in overall size. By rolling up the flexible package 10, 10', 10", 11, 11', 11" and 11''' into a hollow cylinder that has an outside diameter of about 1 inch, the same flexible package 10, 10', 10", 11, 11', 11" and 11''' will have a Maximum Projected 2-Dimensional Area (MP2DA) of 9 square inches (9 inches×1 inch=9 square inches). This represents an 89% reduction in overall size. Desirably, the flexible package 10, 10', 10", 11, 11', 11" and 11''' in the configured 3-dimensional shape for recycling has a Maximum Projected 2-Dimensional Area (MP2DA) of less than about 50% of its post-use configuration. The post-use configuration of the flexible package 10, 10', 10", 11, 11', 11" and 11''' is determined before it is filled with a product 38. Desirably, the flexible package 10, 10', 10", 11, 11', 11" and 11''' in the configured 3-dimensional shape for recycling has a Maximum Projected 2-Dimensional Area (MP2DA) of less than about 60% of its post-use configuration. More desirably, the flexible package 10, 10', 10", 11, 11', 11" and 11''' in the configured 3-dimensional shape for recycling has a Maximum Projected 2-Dimensional Area (MP2DA) of less than about 70% of its post-use configuration. Even more desirably, the flexible package 10, 10', 10", 11, 11', 11" and 11''' in the configured 3-dimensional shape for recycling has a Maximum Projected 2-Dimensional Area (MP2DA) of less than about 80% of its post-use configuration.

Another way of determining the reduction is size of the flexible package 10, 10', 10", 11, 11', 11" and 11''' from its initial flat configuration to its configured 3-dimensional configuration is to measure the initial surface area of the front surface 12. This figure is then compared to the surface area of the front surface 12 of the flexible package 10, 10', 10", 11, 11', 11" and 11''' after it has been configured into a 3-dimension shape. The surface area of the front surface 12 of the flexible package 10, 10', 10", 11, 11', 11" and 11''' in the 3-dimensional shape should be less than about 50% of the initial surface area of the front surface 12 of the flexible package 10, 10', 10", 11, 11', 11" and 11'''. Desirably, the surface area of the front surface 12 of the flexible package 10, 10', 10", 11, 11', 11" and 11''' in the 3-dimensional shape should be less than about 60% of the initial surface area of the front surface 12 of the flexible package 10, 10', 10", 11, 11', 11" and 11'''. More desirably, the surface area of the front surface 12 of the flexible package 10, 10', 10", 11, 11', 11" and 11''' in the 3-dimensional shape should be less than about 75% of the initial surface area of the front surface 12 of the flexible package 10, 10', 10", 11, 11', 11" and 11'''.

Method

This invention also includes a method of configuring the flexible package 10, 10', 10", 11, 11', 11' and 11''' into a 3-dimensional shape to facilitate recycling at a recycling facility. The flexible package 10, 10', 10", 11, 11', 11" and 11''' has a front surface 12, a back surface 14, an open first end 16, a closed second end 18, and a pair of sides 20 and 22 which join the open first end 16 to the closed second end 18 to form an enclosure 24. A recyclable closure 42, 42' or 42" is spaced apart from the open first end 16 and has a first end 44 and a second end 46. The first end 44 is secured to one of the front or back surfaces, 12 or 14 respectively. Optionally, a resealable closure 40 can be formed adjacent to the closing seal 30. The resealable closure 40 permits the flexible package 10, 10', 10", 11, 11', 11" and 11''' to be opened and closed multiple times after the flexible package 10, 10', 10", 11, 11', 11" and 11''' has been opened approximate the closing seal 30. In addition, a tear notch 32 can be formed in one of the pair of sides 26 and 28, at a location above the resealable closure 40. The tear notch 32 facilitates removal of an upper portion 34 of the flexible package 10, 10', 10", 11, 11', 11" and 11''' which is located above the resealable closure 40.

The method includes the steps of filling the enclosure 24 with a product 38. The product 38 can be a single item or two or more identical or different items. The product 38 can be a solid, a semi-solid or a liquid. In some instances, the product 38 could also be a gas or vapor. A closing seal 30 is then formed across the flexible package 10, 10', 10", 11, 11', 11" and 11''' to close the open first end 16. The flexible package 10, 10', 10", 11, 11', 11" and 11''' can be opened adjacent to the closing seal 30 to gain access into the enclosure 24. The flexible package 10, 10', 10", 11, 11', 11" and 11''' can be opened by tearing the upper portion 34 completely away from the remainder of the flexible package 10, 10', 10", 11, 11', 11" and 11'''. Once the flexible package 10, 10', 10", 11, 11', 11" and 11''' is opened, a portion or all of the products 38 can be removed from it. Depending on the product 38, it may take several openings and closings before the flexible package 10, 10', 10", 11, 11', 11" and 11''' is empty. When the flexible package 10, 10', 10", 11, 11', 11" and 11''' is empty, it is then configured into a 3-dimensional shape. This 3-dimensional shape can decrease the overall size of the flexible package 10, 10', 10", 11, 11', 11" and 11''' as well as configures it into a 3-dimensional object. A 3-dimensional object is easier to sort from other flat items, especially 8.5×11 inch sheets of paper and flat newspapers at a recycling facility. The method further includes using the recyclable closure 42, 42' and 42" to retain the flexible package 10, 10', 10", 11, 11', 11" and 11''' in a 3-dimensional shape. The second end 46 of the recyclable closure 42, 42' and 42" is then extended over the closed second end 18 or over one of the pair of sides 20 and 22 of the flexible package 10, 10', 10", 11, 11', 11" and 11'''. The second end 46 of the recyclable closure 42, 42' and 42" is then attached to the same surface to which the first end 44 of the recyclable closure 42, 42' and 42" is secured.

While the invention has been described in conjunction with several specific embodiments, it is to be understood that many alternatives, modifications and variations will be apparent to those skilled in the art in light of the foregoing description. Accordingly, this invention is intended to embrace all such alternatives, modifications and variations which fall within the spirit and scope of the appended claims.

We claim:

1. A flexible package comprising:

a) a front surface, a back surface, an open first end, a closed second end, a pair of sides joining said open first end to said closed second end to form an enclosure, and each of said pair of sides contains a side seal;

b) a closing seal closing said open first end after said enclosure is filled with a product;

c) a resealable closure aligned parallel to said closing seal and extending between said pair of sides, said resealable closure permitting said flexible package to be opened and closed multiple times after said flexible package has been opened approximate said closing seal;

d) a recyclable closure spaced apart from said resealable closure, said recyclable closure having a first end and a second end, and said first end is secured to one of said front or back surfaces; and e) once said enclosure is emptied of said product, said flexible package is rolled or folded into a 3-dimensional shape, and said recyclable closure is used to retain said flexible package in said 3-dimensional shape to facilitate recycling of said flexible package by positioning said second end of said recyclable closure over said closed second end or over one of said pair of sides of said flexible package and then attaching said second end of said recyclable closure to said surface to which said first end of said recyclable closure is secured.

2. The flexible package of claim 1 wherein said closed second end contains a gusset which allows said flexible package to stand upright when filled with a product.

3. The flexible package of claim 1 wherein said flexible package is an empty flat package before it is filled with a product, and said flexible package acquires a 3-dimensional configuration after product is introduced into said enclosure.

4. The flexible package of claim 1 further comprising a tear notch extending inward through one of said side seals, said tear notch located below said closing seal, and said first end of said recyclable closure is secured to said back surface and adjacent to said closed second end.

5. The flexible package of claim 1 wherein said flexible package is formed from a polymer, and said recyclable closure has a non-adhesive portion formed from an identical polymer and an adhesive portion secured to said non-adhesive portion.

6. The flexible package of claim 1 wherein said flexible package has a longitudinal central axis and a vertical central axis, and said recyclable closure is aligned coaxially with said vertical central axis and extends over said closed second end when retaining said flexible package in a 3-dimensional shape.

7. A flexible package comprising:

a) a front surface, a back surface, an open first end, a closed second end which contains a gusset, a pair of sides joining said open first end to said closed second end to form an enclosure, and each of said pair of sides contains a side seal;

b) a closing seal closing said open first end after said enclosure is filled with a product;

c) a resealable closure aligned parallel to said closing seal and extending between said pair of sides, said resealable closure permitting said flexible package to be opened and closed multiple times after said flexible package has been opened approximate said closing seal;

d) a recyclable closure spaced apart from said resealable closure, said recyclable closure having a first end and a second end, and said first end is secured to one of said front or back surfaces; and e) once said enclosure is emptied of said product, said flexible package is rolled or folded into a 3-dimensional shape, and said recyclable closure is used to retain said flexible package in said 3-dimensional shape to facilitate recycling of said flexible package by extending said second end of said recyclable closure over said closed second end or over one of said pair of sides of said flexible package and then attaching said second end of said recyclable closure to said surface to which said first end of said recyclable closure is secured.

8. The flexible package of claim 7 further comprising a tear notch extending inward through one of said side seals, said tear notch located between said closing seal and said resealable closure, said tear notch having a triangular configuration, and said tear notch facilitates removal of an upper portion of said flexible package located above said resealable closure.

9. The flexible package of claim 7 wherein when said first end of said recyclable closure is attached to said back surface, and after said recyclable closure has been used to retain said flexible package in a 3-dimensional shape, said front surface is no longer exposed.

10. The flexible package of claim 9 wherein said flexible package is rolled into a cylinder and said front surface is no longer exposed.

11. The flexible package of claim 7 wherein said flexible package has a longitudinal central axis and a vertical central axis, and said recyclable closure is aligned coaxially with said vertical central axis and extends over said closed second end when retaining said flexible package in a 3-dimensional shape.

12. The flexible package of claim 7 wherein said recyclable closure has an initial length, measured between said first and second ends, which is extendable by at least about 25%.

13. A flexible package comprising:

a) a front surface, a back surface, an open first end, a closed second end which contains a gusset, a pair of sides joining said open first end to said closed second end to form an enclosure, and each of said pair of sides contains a side seal;

b) a closing seal closing said open first end after said enclosure is filled with a product;

c) a tear notch extending inward through one of said side seals, said tear notch located below said closing seal;

d) a resealable closure aligned parallel to said closing seal and extending between said pair of sides, said resealable closure permitting said flexible package to be opened and closed multiple times after said flexible package has been opened approximate said closing seal;

e) a recyclable closure spaced apart from said resealable closure, said recyclable closure having a first end and a second end, and said first end is secured to one of said front or back surfaces; and f) once said enclosure is emptied of said product, said flexible package is rolled or folded into a 3-dimensional shape, and said recyclable closure is used to retain said flexible package in said 3-dimensional shape to facilitate recycling of said flexible package by extending said second end of said recyclable closure over said closed second end or over one of said pair of sides of said flexible package and then attaching said second end of said recyclable closure to said surface to which said first end of said recyclable closure is secured.

14. The flexible package of claim 13 wherein said tear notch has a triangular configuration.

15. The flexible package of claim 13 wherein said flexible package is an empty flat package before it is filled with a product, and said flexible package acquires a 3-dimensional configuration after product is introduced into said enclosure.

16. The flexible package of claim 13 wherein said gusset allows said flexible package to stand upright when filled with a product.

17. The flexible package of claim 13 wherein when said first end of said recyclable closure is attached to said back surface, and after said recyclable closure has been used to retain said flexible package in a 3-dimensional shape, said front surface is no longer exposed.

* * * * *